US008905661B2

(12) United States Patent
Kosuge et al.

(10) Patent No.: US 8,905,661 B2
(45) Date of Patent: Dec. 9, 2014

(54) MEDIUM FEEDER AND PRINTER INCLUDING THE SAME

(71) Applicant: Seiko Epson Corporation, Tokyo (JP)

(72) Inventors: Shinsaku Kosuge, Matsumoto (JP); Hideo Sodeyama, Matsumoto (JP); Kenichi Nakajima, Suwa-gun (JP); Tadashi Inaba, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 105 days.

(21) Appl. No.: 13/748,801

(22) Filed: Jan. 24, 2013

(65) Prior Publication Data

US 2013/0195535 A1 Aug. 1, 2013

(30) Foreign Application Priority Data

Feb. 1, 2012 (JP) ..... 2012-019610
Feb. 1, 2012 (JP) ..... 2012-019611

(51) Int. Cl.
*B41J 15/00* (2006.01)
*B65H 20/02* (2006.01)

(52) U.S. Cl.
CPC ..... *B65H 20/02* (2013.01); *B65H 2301/5151* (2013.01); *B65H 2404/147* (2013.01); *B65H 2701/11332* (2013.01); *B65H 2801/12* (2013.01)
USPC ..... 400/611; 400/88; 400/613

(58) Field of Classification Search
CPC ..... B65H 2404/11; B65H 2404/1118; B65H 2404/1119; B65H 2404/1316; B65H 2404/1341; B65H 2404/1414; B65H 2404/142; B65H 2404/1421; B65H 2404/144; B65H 2404/1526; B65H 2404/1441; B65H 27/00
USPC ..... 399/405; 400/611, 88, 613
See application file for complete search history.

(56) References Cited

U.S. PATENT DOCUMENTS

| | | | | |
|---|---|---|---|---|
| 7,200,356 | B2 * | 4/2007 | Kawamoto | 399/405 |
| 7,322,762 | B2 * | 1/2008 | Murata et al. | 400/615 |
| 8,526,875 | B2 * | 9/2013 | Matsuno et al. | 399/405 |
| 2006/0163803 | A1 * | 7/2006 | Izuchi et al. | 271/272 |
| 2010/0221052 | A1 * | 9/2010 | Mizuno et al. | 399/406 |

FOREIGN PATENT DOCUMENTS

| | | |
|---|---|---|
| JP | 2008-001065 A | 1/2008 |
| JP | 2008-013265 A | 1/2008 |

* cited by examiner

*Primary Examiner* — Matthew G Marini
(74) *Attorney, Agent, or Firm* — ALG Intellectual Property, LLC

(57) ABSTRACT

A medium feeder includes a first rotation body; a second rotation body which engages with the first rotation body while overlapping with the first rotation body, and disengages from the first rotation body in response to the presence of the feed target medium nipped between the first and second rotation bodies; a rotation body support member which supports the second rotation body, and is configured to be movable between an advancing position where the second rotation body engages with the first rotation body and a retreating position where the second rotation body disengages from the first rotation body; and a detection unit which detects migration of the rotation body support member to the retreating position.

12 Claims, 14 Drawing Sheets

MEDIUM FEEDER AND PRINTER INCLUDING THE SAME

CROSS-REFERENCE

The entire disclosure of Japanese Patent Applications No. 2012-019610 filed on Feb. 1, 2012 and No. 2012-019611 filed on Feb. 1, 2012, which are hereby incorporated by reference in their entirety.

BACKGROUND

1. Technical Field

The present invention relates to a medium feeder which rotates to deliver a feed target medium while nipping the medium by a pair of discharge rollers, and a printer including this medium feeder.

2. Related Art

A tape printer (medium feeder) capable of rotating and delivering a printing tape while nipping the printing tape by a pair of discharge rollers (first roller and second roller) is known (see JP-A-2008-001065). This tape printer includes a pair of discharge rollers each of which has an outer circumferential surface made of conductive material and rotates to deliver a printing tape nipped between the pair of the discharge rollers, a pressing mechanism which relatively presses the pair of the discharge rollers in the direction of nipping the printing tape, and a continuity detecting unit connected with a pair of contacts contacting the conductive areas of the respective discharge rollers to detect continuity and discontinuity between the pair of the discharge rollers. The tape printer having this structure detects the presence of the printing tape passing between the pair of the discharge rollers, thereby determining arrival of the printing tape at the discharge rollers and discharge of the printing tape therefrom.

According to this type of medium feeder in the related art, however, the continuity detecting unit detects discontinuity based on adherence of foreign materials to the discharge rollers or insufficient contact between the discharge rollers even when the printing tape does not position between the discharge rollers. In this case, the presence or absence of the printing tape between the discharge rollers is difficult to be accurately determined.

In this type of medium feeder, it is conceivable that the second roller is configured to come close to and away from the first roller so as to securely position the feed target medium between the first roller and the second roller when a part of the feed target medium is located between the first and second rollers which nip the feed target medium and rotate to deliver the feed target medium so that the second roller is positioned away from the first roller when the feed target medium is set, and after the setting of the target medium, the second roller is moved close to the first roller to nip the target medium and rotate to deliver the target medium.

It is also conceivable to configure that the medium feeder includes: a first rotation body attached to a first roller shaft of the first roller; a second rotation body which engages with the first rotation body while overlapping therewith and disengages from the first rotation body in response to the presence of the feed target medium positioned between the first rotation body and the second rotation body; and a rotation body support member which supports the second rotation body in such a manner that the second rotation body can freely rotate around a second roller shaft of the second roller, and freely moves relative to the second roller between an advancing position where the second rotation body engages with the first rotation body and a retreating position where the second rotation body disengages from the first rotation body. In this case, the presence of the feed target medium between the first roller and the second roller can be detected based on the determination that the second rotation body has reached the retreating position, for example.

According to the structure, even if the second roller is moved to the separation position when a part of the set feed target medium positions between the first roller and the second roller which rotate to deliver the feed target medium while nipping the feed target medium therebetween, the space left between the first rotation body and the second rotation body is only a short clearance under the condition in which the second rotation body is located at the advancing position. In this case, the presence of the first rotation body and the second rotation body disturbs the setting of the feed target medium, and gives rise to the possibility that the feed target medium is set in a condition that the feed target medium does not enter the position between the first rotation body and the second rotation body.

SUMMARY

An advantage of some aspects of the invention is to provide a medium feeder which can securely detect the presence or absence of a feed target medium between a pair of rollers which nip the feed target medium and rotate to deliver the feed target medium, and a printer including this medium feeder.

Another advantage of some aspects of the invention is to provide a medium feeder in which a feed target medium can be set in such a manner that the feed target medium securely enters between a first roller and a second roller even when a part of the feed target medium positions between the first roller and the second roller which nip the feed target medium and rotate to deliver the feed target medium.

An aspect of the invention is directed to a medium feeder including: a feed roller which has a first roller and a second roller, and rotates to deliver a feed target medium while nipping the feed target medium; a first rotation body attached to a first roller shaft of the first roller; a second rotation body which engages with the first rotation body while overlapping with the first rotation body, and disengages from the first rotation body in response to the presence of the feed target medium nipped between the first and second rotation bodies; a rotation body support member which supports the second rotation body rotatably around a second roller shaft of the second roller, and is configured to be movable relative to the second roller, and movable between an advancing position where the second rotation body engages with the first rotation body and a retreating position where the second rotation body disengages from the first rotation body; and a detection unit which detects migration of the rotation body support member to the retreating position.

According to this structure, the second rotation body engages with the first rotation body while overlapping therewith when the feed target medium is not present between the first roller and the second roller. However, when the feed target medium positions between the first roller and the second roller, the second rotation body supported rotatably around the second roller shaft rotates and receives the feed target medium without interrupting the passage of the feed target medium by the presence of the first rotation body and the second rotation body. When the feed target medium enters between the first rotation body and the second rotation body, the second rotation body disengages from the first rotation body to cancel the overlapping condition with the first rotation body. As a result, the rotation body support member supporting the second rotation body moves from the advancing position to the retreating position by the sum of the thickness of the feed target medium and the length sufficient for canceling the overlapping condition.

Hence, the moving distance of the rotation body support member between the advancing position and the retreating position can be made large even when the feed target medium is thin. Accordingly, this structure can detect the migration of the rotation body support member to the retreating position with high accuracy, and securely determine the presence or absence of the feed target medium between the first roller and the second roller.

Moreover, the rotation body support member does not move to the retreating position even at the time of adherence of foreign materials to the first roller and the second roller or insufficient contact between the first roller and the second roller. Thus, the presence of the feed target medium is not erroneously detected.

In the aspect of the invention, it is preferable that the medium feeder further includes a rotation member that includes a shaft, an engaging portion which engages with the rotation body support member and reciprocatively rotates around the shaft in accordance with the movement of the rotation body support member between the advancing position and the retreating position, and a detection target portion which reciprocatively rotates around the shaft in accordance with the movement of the rotation body support member between the advancing position and the retreating position, the detection target portion is disposed outside the engaging portion in the radial direction of the shaft, and the detection unit faces to one of the rotation ends of the detection target portion.

According to this structure, the detection target portion is disposed outside the engaging portion engaging with the rotation body support member in the radial direction of the shaft. In this case, the rotation distance of the detection target portion is longer than the rotation distance of the engaging portion dependent on the moving distance of the rotation body support member between the advancing position and the retreating position. Thus, the migration of the rotation body support member to the retreating position can be detected with higher accuracy. In this case, the overlap between the first rotation body and the second rotation body may be reduced by the length corresponding to the difference between the rotation distance of the engaging portion dependent on the moving distance of the rotation body support member and the rotation distance of the detection target portion longer than the rotation distance of the engaging portion.

The migration of the rotation body support member to the retreating position may be detected based on the determination of the detection unit that the detection target portion of the rotation member is present atone of the rotation ends by the rotation of the detection target portion thereto in accordance with the movement of the rotation body support member to the retreating position, or may be detected based on the determination of the detection unit that the detection target portion of the rotation member is not present at the one rotation end by the rotation of the detection target portion to the other rotation end in accordance with the movement of the rotation body support member to the retreating position.

In the aspect of the invention, it is preferable that the first rotation body has a first concavo-convex portion which has an outer circumferential surface concavo-convex in the circumferential direction. In this case, it is preferable that the second rotation body has a second concavo-convex portion which has an outer circumferential surface concavo-convex in the circumferential direction and complementary to the first concavo-convex portion, and thus can engage with the first rotation body while overlapping with the first rotation body.

When the feed target medium is thin or made of soft material, the feed target medium nipped between the first rotation body and the second rotation body is bended along the outer circumferential surfaces of the first rotation body and the second rotation body overlapping with each other. In this case, the overlapping condition is only partially cancelled, in which the rotation body support member may move for a distance corresponding to only a part of the overlap between the advancing position and the retreating position.

According to the structure described above, however, each of the first concavo-convex portion and the second concavo-convex portion has a concavo-convex shape in the circumferential direction. Thus, the feed target medium which is thin or made of soft material is not easily bended in a shape along the first concavo-convex portion and the second concavo-convex portion when positioned between the first rotation body and the second rotation body. Accordingly, this structure can sufficiently cancel the overlapping condition, and thus can securely move the rotation body support member for a distance sufficient for canceling the overlap.

In the aspect of the invention, it is preferable that the first rotation body has a first concavo-convex portion which has an outer circumferential surface concavo-convex in the axial direction, and the second rotation body has a second concavo-convex portion which has an outer circumferential surface concavo-convex in the axial direction and complementary to the first concavo-convex portion to engage with the first rotation body while overlapping with the first rotation body.

According to this structure, the second rotation body can engage with the first rotation body while overlapping with each other via the first concavo-convex portion and the second concavo-convex portion having concavo-convex shapes in the axial direction.

In the aspect of the invention, it is preferable that the detection unit includes a non-contact-type sensor.

It is preferable that the rotation body support member can move by a smallest force so as to enable detection of the feed target medium having a small thickness. According to the structure described above, however, the rotation body support member is not required to have a force for pressing a contact of the sensor when moving to the retreating position unlike the case of the detection unit constituted by a contact-type sensor. Accordingly, the rotation body support member is movable by a smallest force.

In the aspect of the invention, it is preferable that the medium feeder further includes: a medium setting portion to which the feed target medium as a target of delivery by rotation of the feed roller is set; an opening and closing member which opens and closes the medium setting portion; and a connection and disconnection mechanism which moves the second roller close to and away from the first roller between a nip position where the feed target medium is nipped between the first and second rollers and a separation position where the second roller is separated away from the first roller in accordance with closing of the opening and closing member.

According to this structure, the second roller moves to the separation position in accordance with opening of the opening and closing member when a part of the set feed target medium positions between the first and second rollers which rotate to deliver the feed target medium nipped between the first and second rollers. As a result, the clearance between the first and second rollers increases, whereby the feed target medium can securely position between the first and second rollers at the time of setting. Moreover, the second rotation body supported around the second roller shaft moves away from the first rotation body in accordance with the movement of the second roller to the separation position. Thus, the clearance between the first rotation body and the second rotation body increases, whereby the feed target medium can securely position between the first and second rotation bodies at the time of setting.

After the setting of the feed target medium to the medium setting portion, the second roller moves to the nip position in accordance with closing of the opening and closing member, allowing the feed target medium to come into the condition for delivery by rotation of the first and second rollers.

Another aspect of the invention is directed to a printer including: the medium feeder according the above aspect of the invention; and a printing unit which performs printing on the feed target medium delivered by rotation of the medium feeder.

This structure can securely detect the presence or absence of the feed target medium located between the first roller and the second roller which deliver the feed target medium subjected to printing by the printing unit.

Still another aspect of the invention is directed to a medium feeder including: a feed roller which has a first roller and a second roller, and rotates to deliver a feed target medium while nipping the feed target medium; a connection and disconnection mechanism which moves the second roller close to and away from the first roller between a nip position where the feed target medium is nipped between the first and second rollers and a separation position where the second roller is separated away from the first roller; a first rotation body attached to a first roller shaft of the first roller; a second rotation body which engages with the first rotation body while overlapping with the first rotation body, is movable relative to the second roller, and disengages from the first rotation body in response to the presence of the feed target medium nipped between the first and second rotation bodies; a rotation body support member which supports the second rotation body rotatably around a second roller shaft of the second roller, and is configured to be movable relative to the second roller between an advancing position where the second rotation body engages with the first rotation body and a retreating position where the second rotation body disengages from the first rotation body; and an interlock mechanism which moves the rotation body support member from the advancing position to the retreating position with respect to the second roller in accordance with the movement of the second roller from the nip position to the separation position, and moves the rotation body support member from the retreating position to the advancing position with respect to the second roller in accordance with the movement of the second roller from the separation position to the nip position.

According to this structure, the second rotation body supported by the rotation body support member engages with the first rotation body while overlapping therewith when the rotation body support member moves to the advancing position with respect to the second roller in accordance with the movement of the second roller to the nip position. When the feed target medium positions between the first roller and the second roller, the second rotation body supported rotatably around the second roller shaft rotates and receives the feed target medium without interrupting passage of the feed target medium by the presence of the first rotation body and the second rotation body. When the feed target medium enters between the first rotation body and the second rotation body, the second rotation body disengages from the first rotation body to cancel the condition overlapping with the first rotation body. As a result, the rotation body support member supporting the second rotation body moves from the advancing position to the retreating position by the sum of the thickness of the feed target medium and the length sufficient for canceling the overlapping condition.

On the other hand, when the second roller moves to the separation position, the rotation body support member moves to the retreating position with respect to the second roller in accordance with the movement of the second roller to the separation position. In this condition, the second rotation body supported by the rotation body support member does not project toward the first rotation body from the second roller. Thus, at the time of setting of the feed target medium such that a part of the feed target medium positions between the first roller and the second roller which rotate to deliver the feed target medium nipped therebetween, the second roller can be disposed at the separation position away from the first roller, while the second rotation body can be positioned away from the first rotation body. Accordingly, the clearances between the first roller and the second roller and between the first rotation body and the second rotation body both increase, therefore the feed target medium can securely position into these clearances for setting.

In the aspect of the invention, it is preferable that the interlock mechanism includes an urging member which urges the rotation body support member toward the advancing position, and an interlock engaging portion and an interlock engagement receiving portion which engage with each other in accordance with the movement of the second roller from the nip position to the separation position, and disengage from each other in accordance with the movement of the second roller from the separation position to the nip position. In this case, the interlock mechanism preferably moves the rotation body support member from the advancing position to the retreating position by engagement between the interlock engaging portion and the interlock engagement receiving portion while resisting the urging member, and allows movement of the rotation body support member toward the advancing position by the operation of the urging member in accordance with disengagement between the interlock engaging portion and the interlock engagement receiving portion.

According to this structure, the interlock engaging portion and the interlock engagement receiving portion disengage from each other when the second roller moves to the nip position. As a result, the rotation body support member urged by the urging member moves to the advancing position. On the other hand, when the second roller moves to the separation position, the interlock engaging portion and the interlock engagement receiving portion engage with each other, whereby the rotation body support member can move to the retreating position while resisting the urging member.

In the aspect of the invention, it is preferable that the interlock mechanism further includes a rotation member that includes a shaft on the outer circumferential surface of which the interlock engaging portion is provided, and a support member engaging portion which engages with the rotation body support member and reciprocatively rotates around the shaft in accordance with the engagement and disengagement between the interlock engaging portion and the interlock engagement receiving portion so as to move the rotation body support member between the advancing position and the retreating position. In this case, the rotation member preferably allows the interlock engaging portion to move to an engagement position where the interlock engaging portion engages with the interlock engagement receiving portion in accordance with the movement of the second roller from the nip position to the separation position, and allows the interlock engaging portion to move to a disengagement position where the interlock engaging portion disengages from the interlock engagement receiving portion in accordance with the movement of the second roller from the separation position to the nip position.

According to this structure, when the second roller moves to the nip position, the rotation member moves to the disengagement position to allow disengagement of the interlock engaging portion from the interlock engagement receiving portion. As a result, the support member engaging portion rotates to move the rotation body support member to the advancing position. On the other hand, when the second roller moves to the separation position, the rotation member moves to the engagement position to allow engagement between the interlock engaging portion and the interlock engagement receiving portion. As a result, the support member engaging portion rotates to move the rotation body support member to the retreating position.

In the aspect of the invention, it is preferable that the rotation member further includes a detection target portion which reciprocatively rotates around the shaft in accordance with the movement of the rotation body support member between the advancing position and the retreating position. In this case, the medium feeder preferably further includes a detection unit which faces to one of the rotation ends of the detection target portion.

According to this structure, the rotation body support member moves to the retreating position when the feed target medium enters between the first roller and the second roller under the condition of the second roller located at the nip position. Then, the detection target portion of the rotation member rotates to the one rotation end in accordance with the movement of the rotation body support member to the retreating position, in which the detection unit detects the presence of the detection target portion at the one rotation end, and determines that the rotation body support member has moved to the retreating position. This determination allows detection of the presence or absence of the feed target medium between the first roller and the second roller.

Alternatively, the migration of the rotation body support member to the retreating position may be detected based on detection of the absence of the detection target portion of the rotation member at the one rotation end when the detection target portion rotates to the other rotation end in accordance with the movement of the rotation body support member to the retreating position.

In the aspect of the invention, it is preferable that the medium feeder further includes: a medium setting portion to which the feed target medium as a target of delivery by rotation of the feed roller is set; and an opening and closing member which opens and closes the medium setting portion, the connection and disconnection mechanism moves the second roller from the nip position to the separation position in accordance with opening of the opening and closing member, and moves the second roller from the separation position to the nip position in accordance with closing of the opening and closing member.

According to this structure, the second roller can move to the separation position in accordance with opening of the opening and closing member at the time of setting of the feed target medium. After setting of the feed target medium, the second roller can move to the nip position in accordance with closing of the opening and closing member.

Yet another aspect of the invention is directed to a printer including: the medium feeder according to the aspect of the invention; and a printing unit which performs printing on the feed target medium delivered by rotation of the medium feeder.

According to this structure, the feed target medium can be easily set when the feed target medium is set such that a part of the feed target medium subjected to printing by the printing unit positions between the first roller and the second roller.

BRIEF DESCRIPTION OF THE DRAWINGS

The invention will be described with reference to the accompanying drawings, wherein like numbers reference like elements.

FIGS. 10A through 10C are plan views showing a series of actions of a part around a driven side rotation body at the time of opening and closing of an opening and closing cover and during feed operation of a printing tape, wherein: FIG. 10A is a plan view when the opening and closing cover is opened; FIG. 10B is a plan view when the printing tape is not present between a driving side rotation body and the driven side rotation body with the opening and closing cover closed; and FIG. 10C is a plan view when the printing tape positions between the driving side rotation body and the driven side rotation body with the opening and closing cover closed.

FIGS. 11A through 11C are plan views showing a series of actions of a part around a discharge driving roller and a discharge driven roller at the time of opening and closing of the opening and closing cover and during feed operation of the printing tape, wherein: FIG. 11A is a plan view when the opening and closing cover is opened; FIG. 11B is a plan view when the printing tape is not present between the driving side rotation body and the driven side rotation body with the opening and closing cover closed; and FIG. 11C is a plan view when the printing tape positions between the driving side rotation body and the driven side rotation body with the opening and closing cover closed.

FIGS. 12A through 12C are front views showing a series of actions of apart around the discharge driving roller and the discharge driven roller at the time of opening and closing of the opening and closing cover and during feed operation of the printing tape, wherein: FIG. 12A is a front view when the opening and closing cover is opened; FIG. 12B is a front view when the printing tape is not present between the driving side rotation body and the driven side rotation body with the opening and closing cover closed; and FIG. 12C is a front view when the printing tape positions between the driving side rotation body and the driven side rotation body with the opening and closing cover closed.

FIGS. 13A through 13C are front views showing a series of actions of apart around the discharge driving roller, the discharge driven roller, and a hook member at the time of opening and closing of the opening and closing cover and during feed operation of the printing tape, wherein: FIG. 13A is a front view when the opening and closing cover is opened; FIG. 13B is a front view when the printing tape is not present between the driving side rotation body and the driven side rotation body with the opening and closing cover closed; and FIG. 13C is a front view when the printing tape positions between the driving side rotation body and the driven side rotation body with the opening and closing cover closed.

FIGS. 14A through 14D illustrate a driving side rotation body and a driven side rotation body according to another embodiment, wherein: FIG. 14A is a plan view when the driving side rotation body and the driven side rotation body engage with each other; FIG. 14B is a front view when the driving side rotation body and the driven side rotation body engage with each other; FIG. 14C is a plan view when the driving side rotation body and the driven side rotation body disengage from each other; and FIG. 14D is a front view when the driving side rotation body and the driven side rotation body disengage from each other.

DESCRIPTION OF EXEMPLARY EMBODIMENTS

A medium feeder according to an embodiment of the invention is hereinafter described with reference to the accompanying drawings. In this embodiment, a tape printer will be discussed as an example of the medium feeder. The tape printer according to this embodiment performs printing on a printing tape corresponding to a printing target material while delivering the printing tape, cuts the printed portion of the printing tape while carrying out half cutting of the printing tape, and discharges a tape piece (label) thus produced to the outside of the device. In the following description of this embodiment, the directions "front", "rear", "right", "left", "up", and "down" are defined as corresponding directions as viewed from a user operating the tape printer (front view).

Figure 1:
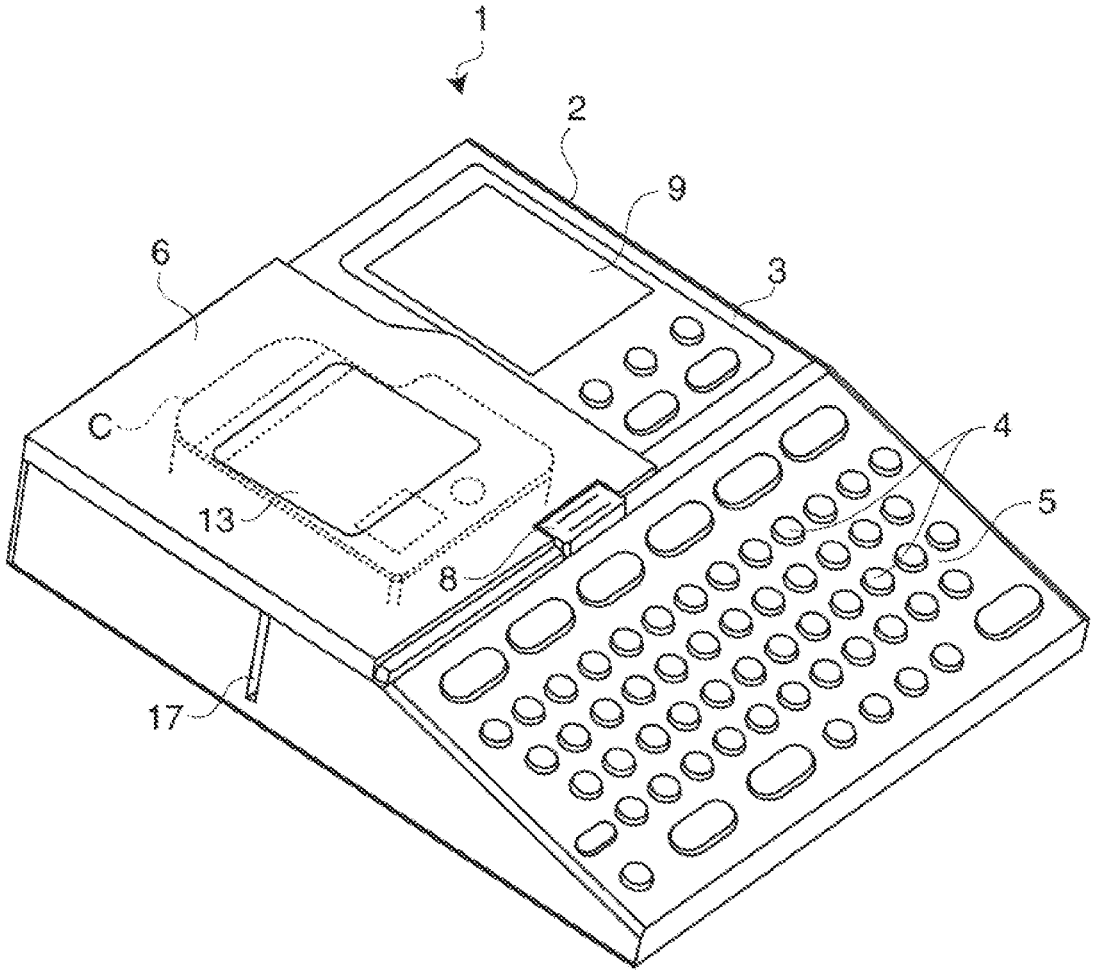
FIG. 1 is a perspective view illustrating the external appearance of a tape printer whose cover is closed according to an embodiment.
Figure 2:
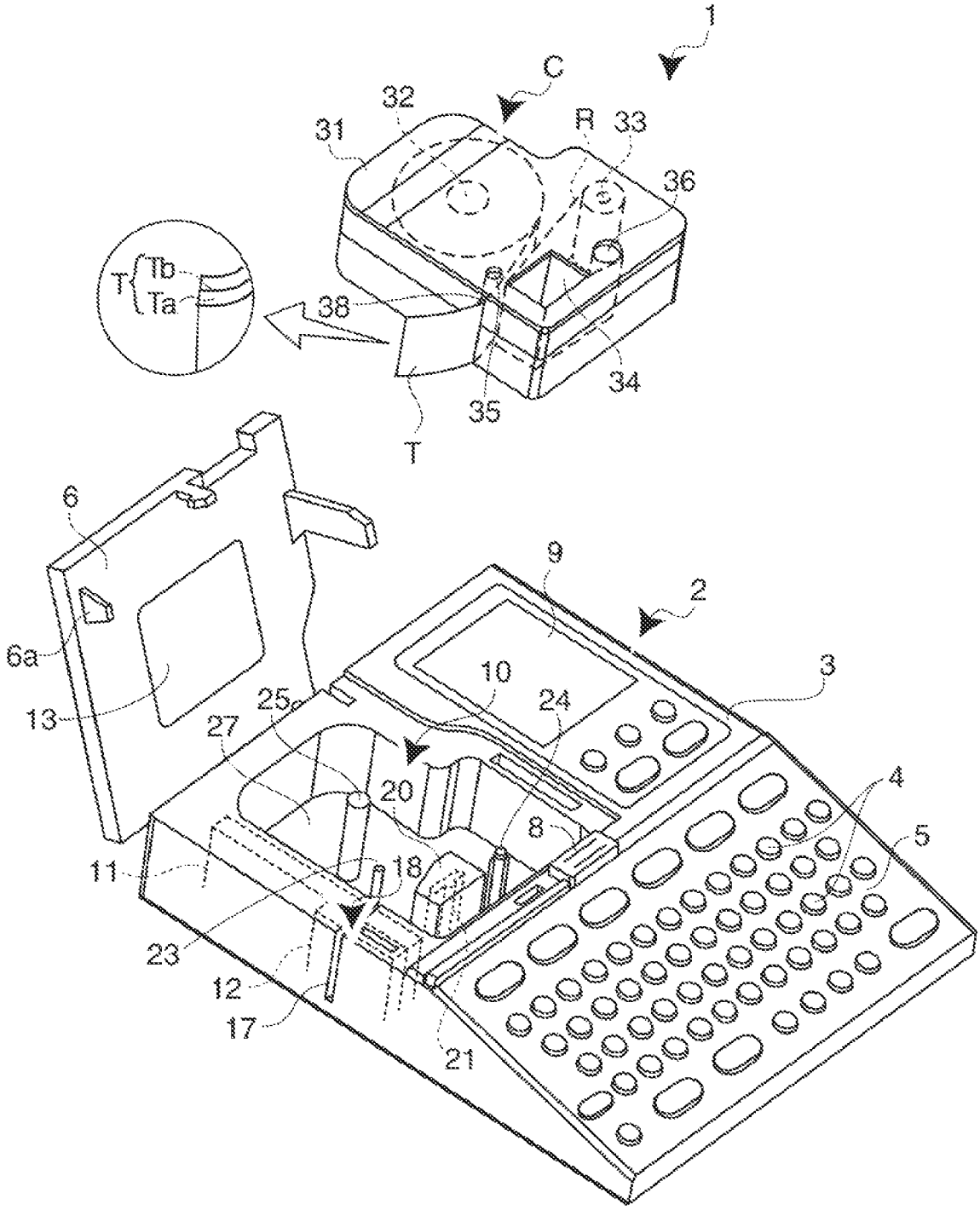
FIG. 2 is a perspective view illustrating the external appearance of the tape printer whose cover is opened.

As illustrated in FIGS. 1 and 2, a tape printer 1 includes a device main body 2 which performs printing on a printing tape T, and a tape cartridge C which houses the printing tape T and an ink ribbon R and is detachably set to the device main body 2. The printing tape T as a printing target material provided with a release tape Tb is accommodated within the tape cartridge C in such a condition as to be freely drawn from the tape cartridge C.

The outside case of the device main body 2 is constituted by a device case 3. A keyboard 5 provided with various types of keys 4 is disposed on the front half part of the upper surface of the device case 3. On the other hand, an opening and closing cover 6 occupying a wide area of the left rear half part of the upper surface of the device case 3 opens and closes in the up-down direction around a hinge (not shown) provided at the rear end of the device case 3. A cover opening button 8 which opens the opening and closing cover 6 is provided in front of the opening and closing cover 6. A rectangular display 9 is equipped on the right rear half part of the upper surface of the device case 3 to display input results and the like received from the keyboard 5.

When the opening and closing cover 6 is opened by the press of the cover opening button 8, a cartridge attachment portion 10 to which the tape cartridge C is detachably set with the opening and closing cover 6 opened appears as an inside concave. In other words, the opening and closing cover 6 opens and closes the cartridge attachment portion 10. The opening and closing cover 6 has an operational projection **6*a* projecting from the left front part of the lower surface of the opening and closing cover 6 and engaging with a hook member 175 (described below), and a check window 13 through which the attachment and detachment of the tape cartridge C is visually checked with the cartridge attachment portion 10** closed.

A tape discharge port 17 communicating with the cartridge attachment portion 10 is formed in the left side of the device case 3. A tape discharge channel 18 is provided between the cartridge attachment portion 10 and the tape discharge port 17. A tape cutting mechanism 11 which cuts the printing tape T, and a tape discharging mechanism 12 which discharges a tape piece of the printing tape T produced after cutting from the tape discharge port 17, are both housed as assemblies within the device case 3, and disposed in this order from the upstream side in such positions as to face to the tape discharge channel 18.

The cartridge attachment portion 10 includes a thermal type printing head 21 containing a plurality of heating elements within a head cover 20, a platen driving shaft 23 disposed opposed to the printing head 21, a winding driving shaft 24 around which the ink ribbon R is wound, and a positioning projection 25 for a tape reel 32 (described below). The platen driving shaft 23 and the winding driving shaft 24 penetrate a bottom plate 27 of the cartridge attachment portion 10. A tape feed power system 26 (see FIG. 5) corresponding to a power system for driving the platen driving shaft 23 and the winding driving shaft 24 is equipped in the space below the bottom plate 27.

The tape cartridge C houses the tape reel 32 around which the printing tape T is wound, and a ribbon reel 33 around which the ink ribbon R is wound. The tape reel 32 and the ribbon reel 33 are disposed in the upper central area and in the lower right part within the cartridge case 31, respectively, in such conditions as to freely rotate. The printing tape T and the ink ribbon R have the same width. A through hole 34 into which the head cover 20 covering the printing head 21 is inserted is formed on the lower left side of the tape reel 32. A platen roller 35 which rotates by engagement with the platen driving shaft 23 is disposed at the position corresponding to the location where the printing tape T and the ink ribbon R overlap with each other. A ribbon winding reel 36 which rotates by engagement with the winding driving shaft 24 is also provided at a position close to the ribbon reel 33.

When the tape cartridge C is set to the cartridge attachment portion 10, the head cover 20 and the positioning projection 25 are inserted into the through hole 34 and the center hole of the tape reel 32, respectively. Furthermore, the platen driving shaft 23 and the winding driving shaft 24 are inserted into the center hole of the platen roller 35 and the center hole of the ribbon winding reel 36, respectively. The printing tape T drawn from the tape reel 32, and the ink ribbon R drawn from the ribbon reel 33 in accordance with the rotations of the platen driving shaft 23 and the winding driving shaft 24 pass through the through hole 34 while traveling in parallel and overlapping with each other. Then, the printing tape T is discharged through a tape outlet port 38 formed in the side surface of the cartridge case 31 toward the outside of the cartridge case 31, while the ink ribbon R is wound around the ribbon winding reel 36. The platen roller 35 and the printing head 21 face to the portions of the printing tape T and the ink ribbon R traveling in parallel between the platen roller 35 and the printing head 21 to perform so-called printing feed.

The printing tape T is constituted by a recording tape Ta on the rear surface of which an adhesive layer is formed, and a release tape Tb affixed to the recording tape Ta via the adhesive layer. The printing tape T is housed while being wound around the tape reel 32 with the recording tape Ta and the release tape Tb positioned outside and inside, respectively. There are various types of tapes prepared as the printing tape T (different in tape width, base color, base patterns, and material (feel of material) of the printing tape T, for example). Each of the types of the printing tape T is housed in the cartridge case 31 together with the ink ribbon R. The tape widths of the printing tape T prepared for use range from 4 mm to 36 mm, and the tape thicknesses range from 0.1 mm to 0.8 mm, for example.

A plurality of holes (not shown) are formed in the rear surface of the cartridge case 31 to specify the types of the printing tape T. On the other hand, a plurality of tape identification sensors 37 (see FIG. 4) capable of detecting the bit patterns of the holes such as micro-switches are provided on the cartridge attachment portion 10 at positions corresponding to the plural holes. The tape types (particularly the tape widths) are determined based on the condition of the plural holes detected by the tape identification sensors 37.

When the opening and closing cover 6 is closed with the tape cartridge C set to the cartridge attachment portion 10, the printing head 21 rotates by the function of a head release mechanism (not shown), whereby the printing tape T and the ink ribbon R position between the printing head 21 and the platen roller 35 to come into the printing standby condition of the tape printer 1.

In response to a command requesting printing operation issued after completion of inputting and editing of printing data, the platen roller 35 rotates to draw the printing tape T from the tape cartridge C, while the printing head 21 initiates operation to perform desired printing on the printing tape T. In accordance with the printing operation, the ink ribbon R is wound inside the tape cartridge C, while the printed portion of the printing tape T is delivered to be discharged through the tape discharge port 17 to the outside of the device.

At the end of printing, the tape cutting mechanism 11 performs full cutting of the rear end of the printed portion of the printing tape T along with half cutting of the printing tape T. The "full cutting" in this context refers to a cutting operation for cutting the whole of the printing tape T, i.e., cutting both the recording tape Ta and the release tape Tb as one piece. On the other hand, the "half cutting" refers to a cutting operation for cutting only the recording tape Ta without cut of the release tape Tb. The half cutting may be an operation for cutting only the release tape Tb instead of the recording tape Ta.

After the cutting, only the leading end of the tape piece is discharged through the tape discharge port 17 by the operation of the tape discharging mechanism 12. A label on which desired characters or the like are printed is finally produced at the end of these processes.

Figure 3:
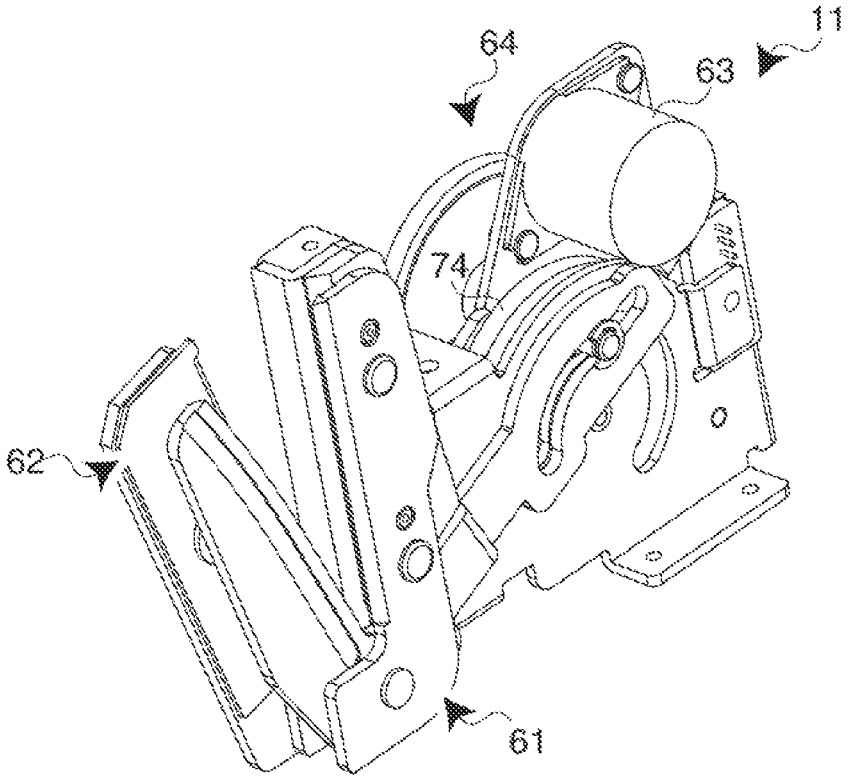
FIG. 3 is a perspective view illustrating a tape cutting mechanism.

As illustrated in FIG. 3, the tape cutting mechanism 11 includes a scissors-type full cuter 61 used for full cutting of the printing tape T, a press-cut-type half cutter 62 provided on the downstream side with respect to the full cutter 61 in the tape feed direction and used for half cutting of the printing tape T, a cutter motor 63 constituted by a stepping motor and providing a driving source for the full cutter 61 and the half cutter 62, a cutter power transmission mechanism 64 which transmits the power of the cutter motor 63 to the full cutter 61 and the half cutter 62, and a cutter position detection sensor 67 (see FIG. 4) facing to a position of the circumferential surface of a crank disc 74 included in the cutter power transmission mechanism 64 to detect the initial position of the crank disc 74. According to this structure, the full cutter 61 performs cutting when the crank disc 74 rotates in the normal direction from the initial position and then rotates in the reverse direction to return to the initial position. On the other hand, the half cutter 62 performs cutting when the crank disc 74 rotates in the reverse direction from the initial position and then rotates in the normal direction to return to the initial position.

Figure 4:
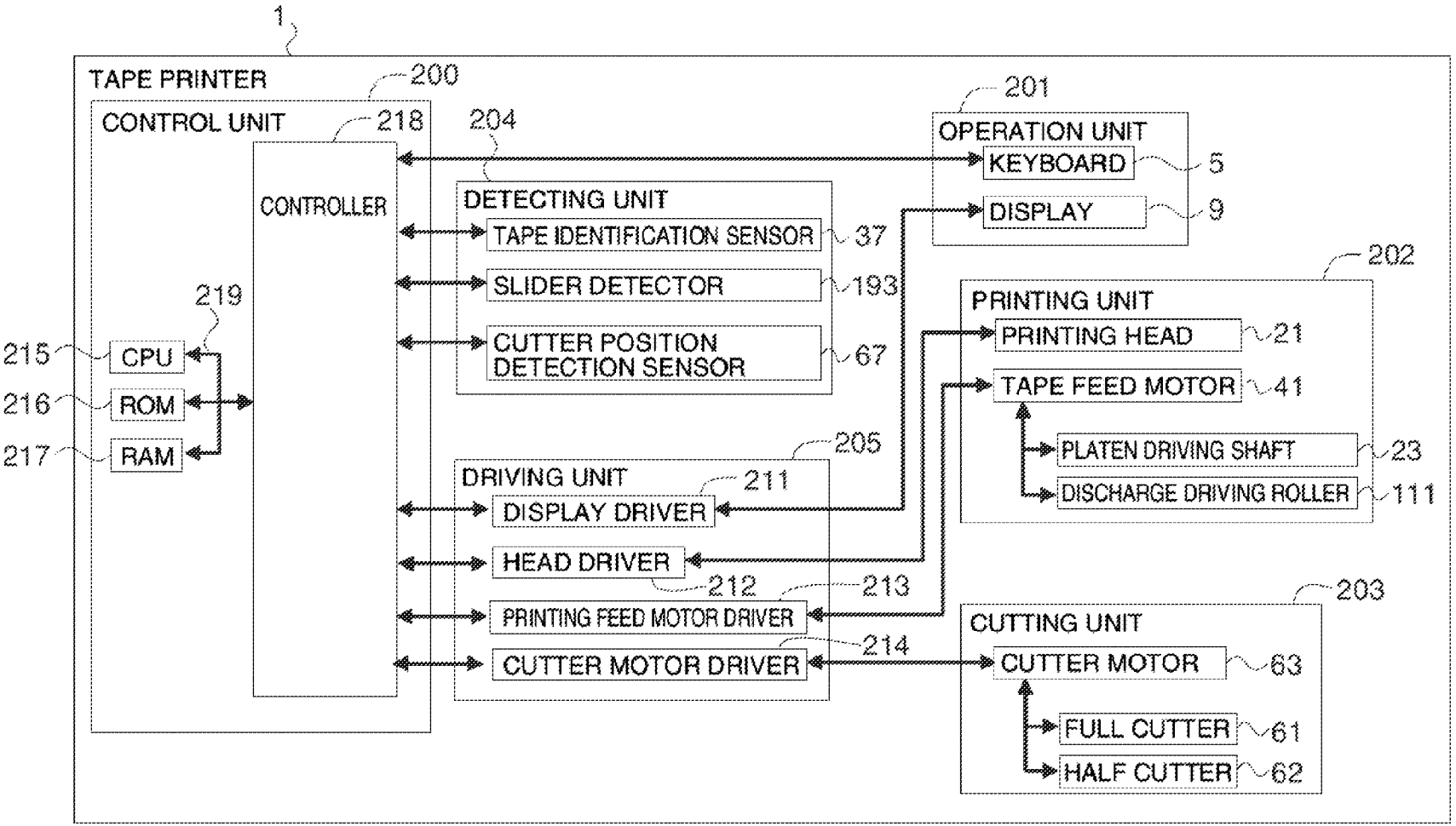
FIG. 4 is a control block diagram of the tape printer.

A control system of the tape printer 1 is now explained with reference to FIG. 4. The tape printer 1 includes an operation unit 201, a printing unit 202, a cutting unit 203, and a detecting unit 204. The tape printer 1 further includes a driving unit 205 which has a display driver 211 for driving the display 9, a head driver 212 for driving the printing head 21, a printing feed motor driver 213 for driving a tape feed motor 41, and a cutter motor driver 214 for driving the cutter motor 63. The tape printer 1 also includes a control unit 200 which connects with these units and controls the overall operation of the tape printer 1.

The operation unit 201 provided with the keyboard 5 and the display 9 functions as an interface with the user. For example, the operation unit 201 receives input of character information through the keyboard 5, and displays various types of information on the display 9.

The printing unit 202 contains the tape feed motor 41 for rotating the platen roller 35 and a discharge driving roller 111 (described below), and the printing head 21. The printing unit 202 rotates the platen roller 35 by the drive of the tape feed motor 41 to forward the printing tape T. The printing unit 202 also performs printing on the delivered printing tape T by the operation of the printing head 21 in accordance with the inputted character information. The printing unit 202 further rotates the discharge driving roller 111 by the drive of the tape feed motor 41 to discharge the printing tape T.

The cutting unit 203 provided with the cutter motor 63 for driving the full cutter 61 and the half cutter 62 allows the full cutter 61 and the half cutter 62 to perform full cutting and half cutting for the printing tape T, respectively, by the drive of the cutter motor 63 after printing.

The detecting unit 204 provided with the tape identification sensors 37, the cutter position detection sensor 67, and a slider detector 193 (described below) detects the tape types, the cutter position, and the presence or absence of the printing tape T, and outputs the detection results to the control unit 200.

The control unit 200 includes a CPU (central processing unit) 215, a ROM (read only memory) 216, a RAM (random access memory) 217, and a controller (IOC: input output controller) 218, all of the parts of which 215 through 218 connect with each other via an internal bus 219. The CPU 215 receives various types of signals and data from the respective units within the tape printer 1 via the controller 218 under control programs stored in the ROM 216. The CPU 215 processes various data within the RAM 217 based on the received various signals and data, and outputs various signal data to the respective units within the tape printer 1 via the controller 218. The control unit 200 thus constructed controls the printing process and the cutting process based on the detection results received from the detecting unit 204, for example.

Figure 5:
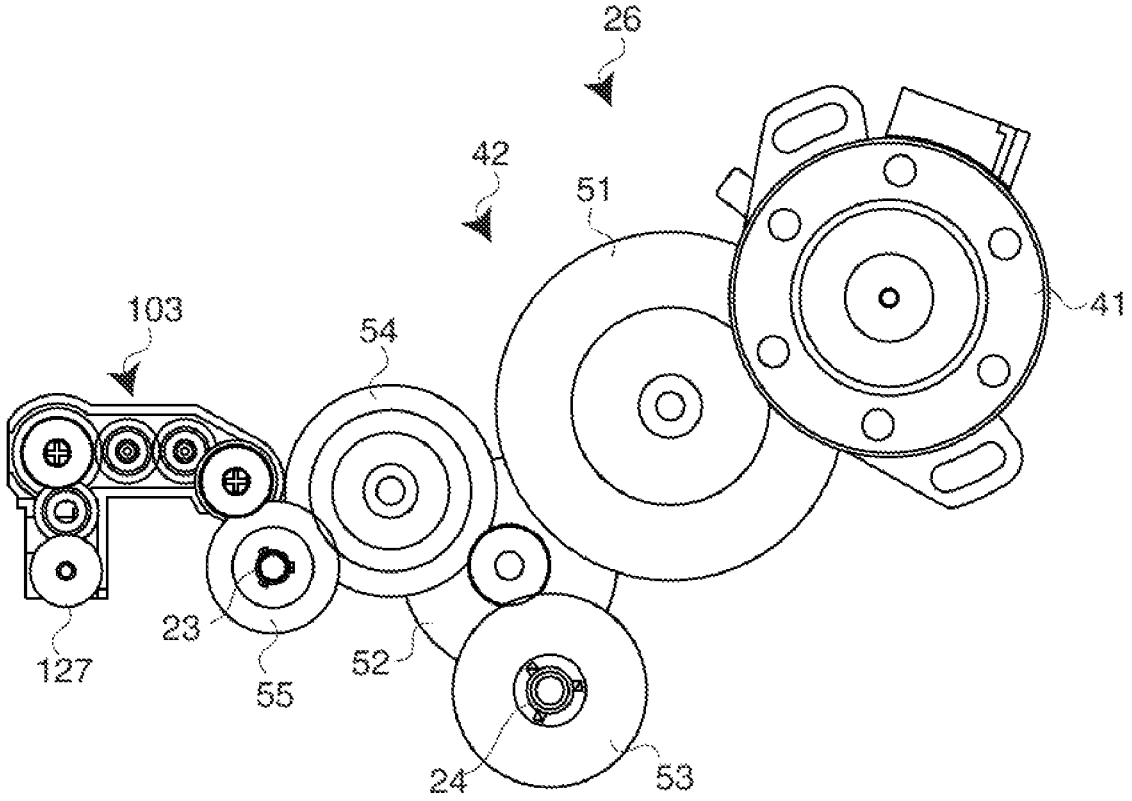
FIG. 5 is a plan view illustrating a tape feed power system.
Figure 6A:
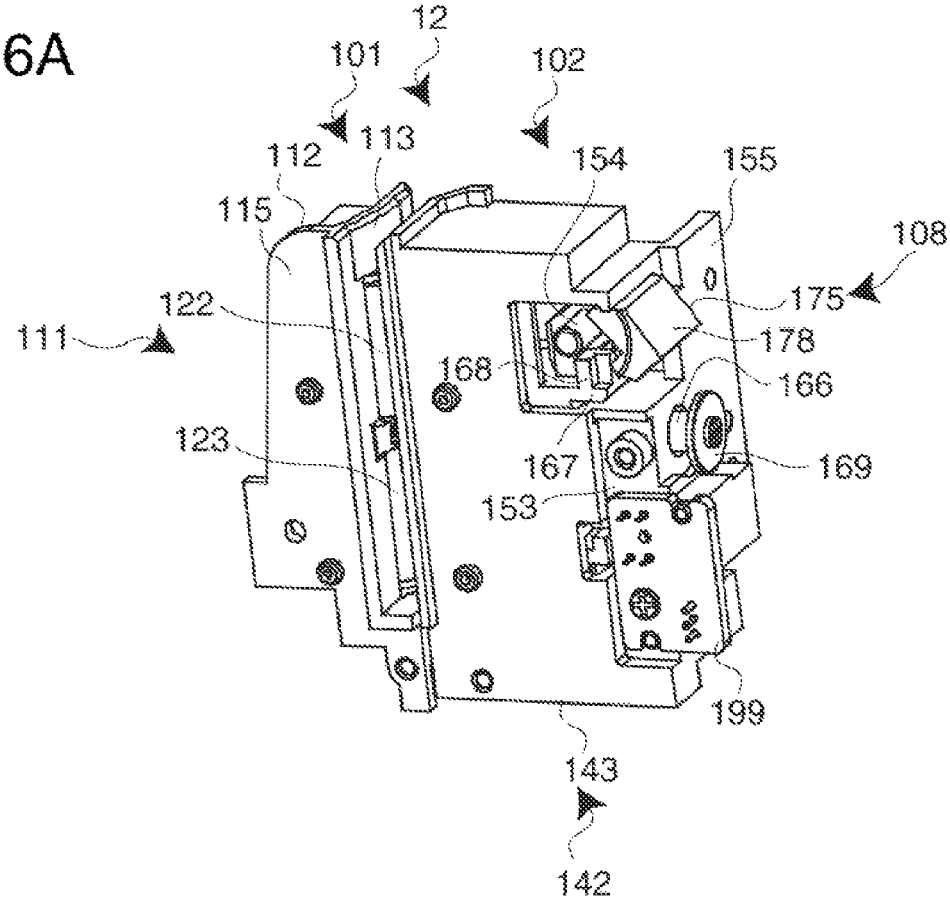
FIG. 6A is a perspective view of a tape discharging mechanism as viewed from the upstream side in the tape feed direction.
Figure 6B:
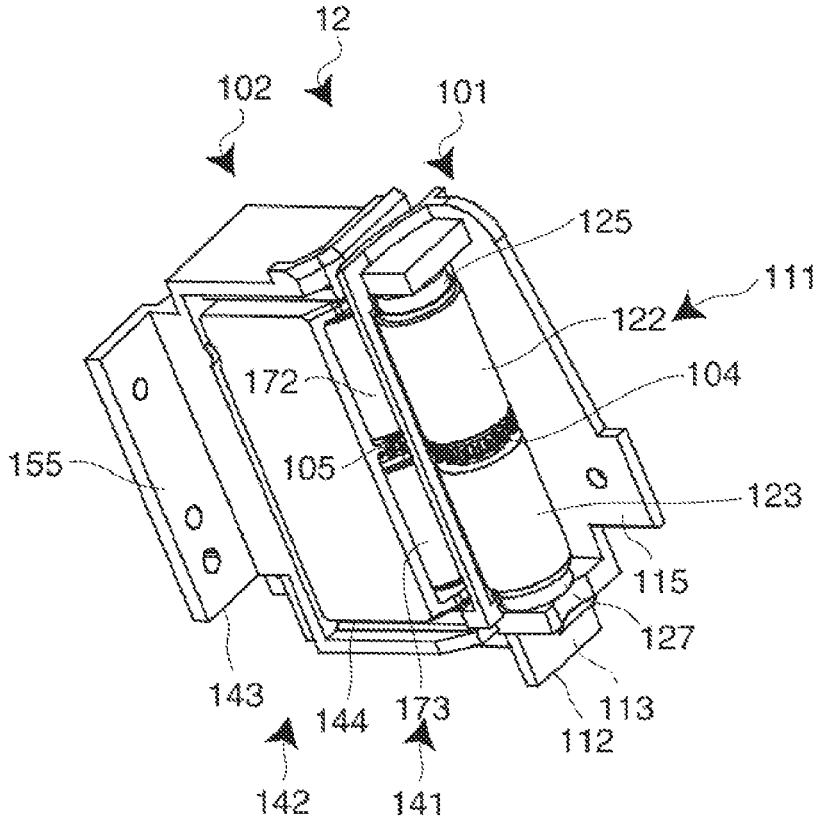
FIG. 6B is a perspective view of the tape discharging mechanism as viewed from the downstream side in the tape feed direction.

As illustrated in FIG. 5, the tape feed power system 26 includes the tape feed motor 41 corresponding to the power source, and a feed power transmission mechanism 42 which transmits the power of the tape feed motor 41 to the platen driving shaft 23 and the winding driving shaft 24. Accordingly, the tape feed motor 41 functions as power sources for both the platen driving shaft 23 and the winding driving shaft 24. The tape feed motor 41 also functions as a power source for the discharge driving roller 111 of the tape discharging mechanism 12, the details of which will be explained below.

The feed power transmission mechanism 42 includes an input gear 51 which engages with a gear provided on the main shaft of the tape feed motor 41, a branch gear 52 which engages with the input gear 51 and branches power into a part given to the platen driving shaft 23 and a part given to the winding driving shaft 24, a first output gear 53 which engages with the branch gear 52 and receives the shaft of the winding driving shaft 24 to rotate the winding driving shaft 24, a relay gear 54 which engages with the branch gear 52, and a second output gear 55 which engages with the relay gear 54 and receives the shaft of the platen roller 35 to rotate the platen roller 35. When the tape feed motor 41 drives, the platen driving shaft 23 and the winding driving shaft 24 rotate by the drive transmitted through the respective gears. The rotations of the platen driving shaft 23 and the winding driving shaft 24 forward the printing tape T, and wind the ink ribbon R in synchronization with the feed of the printing tape T.

The details of the tape discharging mechanism 12 are now discussed with reference to FIGS. 6A through 9. The tape discharging mechanism 12 rotates to deliver the printing tape T, and discharges the printing tape T by using a nip roller (feed roller) which has the discharge driving roller 111 (first roller) rotatable in contact with the release tape Tb of the printing tape T, and a discharge driven roller 141 (second roller) rotatable in contact with the recording tape Ta.

The tape discharging mechanism 12 includes a driving roller unit 101 provided with the discharge driving roller 111, a driven roller unit 102 provided with the discharge driven roller 141 disposed opposed to the discharge driving roller 111, and a discharge power transmission mechanism 103 (see FIG. 5) which transmits rotational power of the tape feed motor 41 branched from the power transmitted through the feed power transmission mechanism 42 to the discharge driving roller 111.

The tape discharging mechanism 12 further includes a driving side rotation body 104 and a driven side rotation body 105 having gear shapes and engaging with each other with overlap therebetween, a rotation body slider 106 which freely slides while supporting the driven side rotation body 105 such that the driven side rotation body 105 can engage with and disengage from the driving side rotation body 104, a detection mechanism 107 which detects the condition of the rotation body slider 106 slid to one moving end, and a connection and disconnection mechanism 108 which moves the discharge driven roller 141 close to and away from the discharge driving roller 111 in accordance with opening and closing of the opening and closing cover 6.

Figure 7:
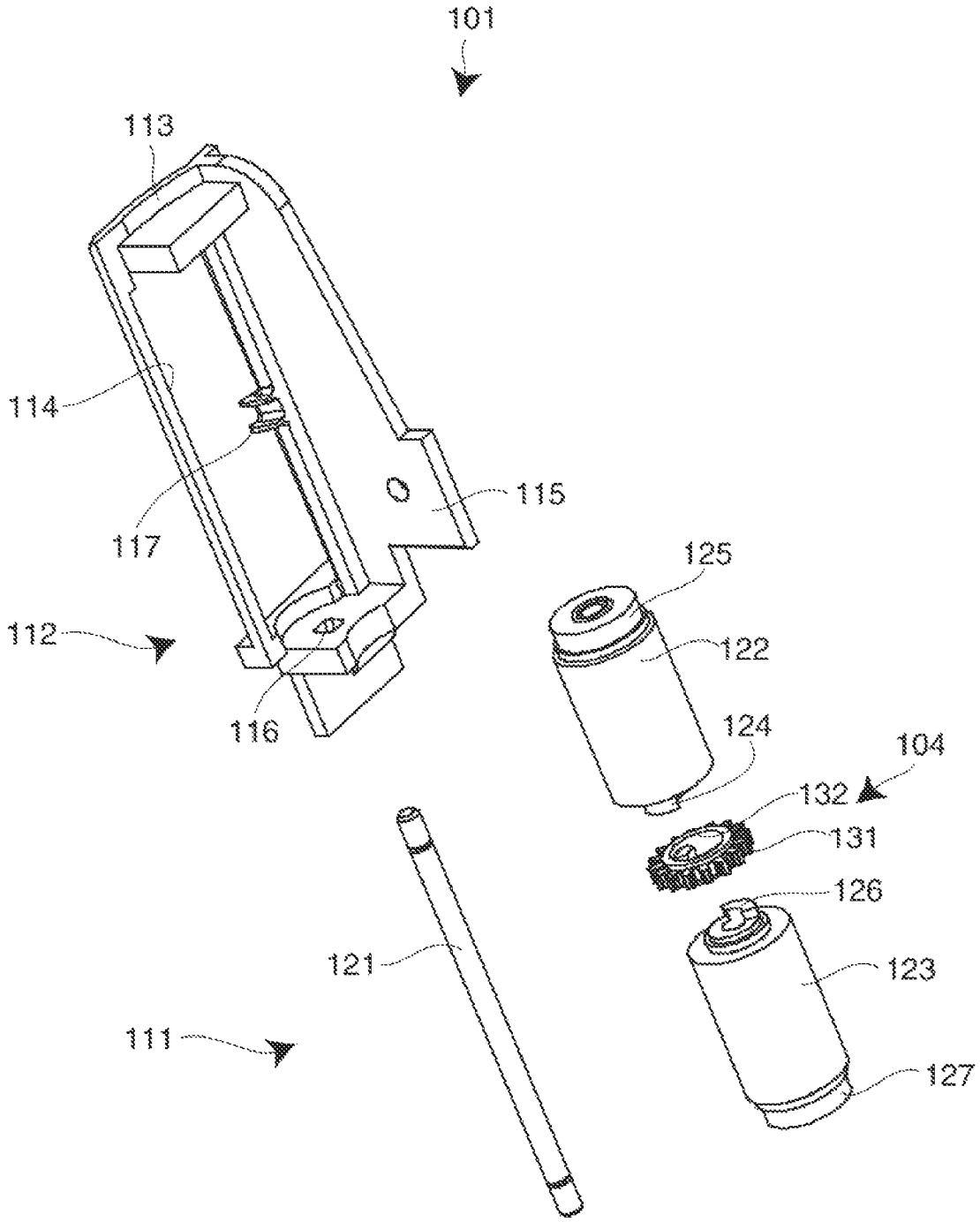
FIG. 7 is a perspective view of a part of the tape discharging mechanism around a driving roller unit in a disassembled condition.

As illustrated in FIG. 7, the driving roller unit 101 has the discharge driving roller 111, and a driving roller holder 112 which holds the discharge driving roller 111 and the driving side rotation body 104 such that the roller 111 and the rotation body 104 can freely rotate.

The driving roller holder 112 has an opening piece 113 facing to the driven roller unit 102 and having a substantially rectangular driving roller opening 114, and a driving side attachment piece 115 projecting toward the rear from the outer edge of the driving roller opening 114 on the downstream side in the tape feed direction to form a portion attached to a base frame (not shown). A pair of driving roller bearings 116 are provided outside the driving roller opening 114 on the upper and lower sides. The discharge driving roller 111 and the driving side rotation body 104 are rotatably supported by the pair of the driving roller bearings 116, and slightly projected from the driving roller opening 114 toward the driven roller unit 102. A rotation body receiving portion 117 having a substantially C shape and projecting toward the inside of the driving roller opening 114 is provided approximately in the middle area of the edge of the driving roller opening 114 in the up-down direction and on the downstream side in the tape feed direction so as to receive the outer circumference of the driving side rotation body 104.

The discharge driving roller 111 has a driving roller shaft 121 whose upper and lower ends are supported by the pair of the driving roller bearings 116, and a driving side upper roller main body 122 and a driving side lower roller main body 123 rotatably supported by the driving roller shaft 121.

An upper roller engaging convex 124 engaging with a driving side rotation body hole 132 (described below) of the driving side rotation body 104 is provided at the lower end of the driving side upper roller main body 122. On the other hand, an upper roller gear 125 is provided at the upper end of the driving side upper roller main body 122.

The driving side lower roller main body 123 has a structure similar to that of the driving side upper roller main body 122. A lower roller engaging convex 126 engaging with the driving side rotation body hole 132 of the driving side rotation body 104 is provided at the upper end of the driving side lower roller main body 123. On the other hand, a lower roller gear 127 is provided at the lower end of the driving side lower roller main body 123. The downstream side end of the discharge power transmission mechanism 103 engages with the lower roller gear 127.

Figure 11A:
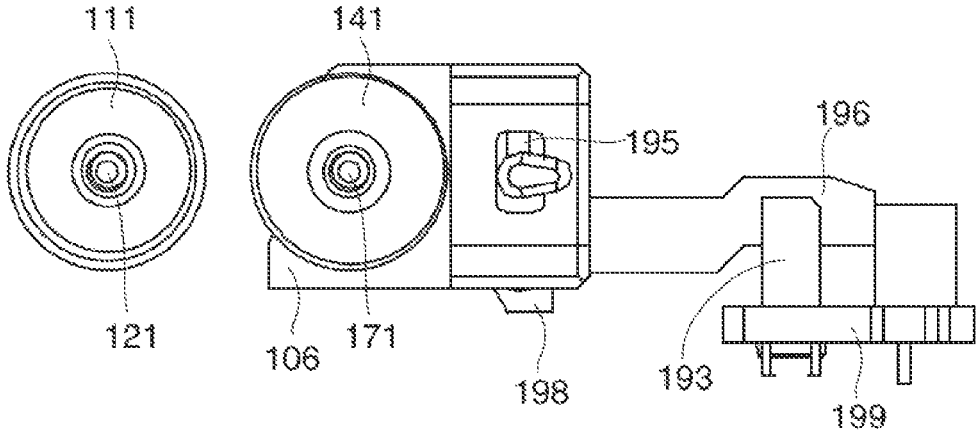
Figure 11B:
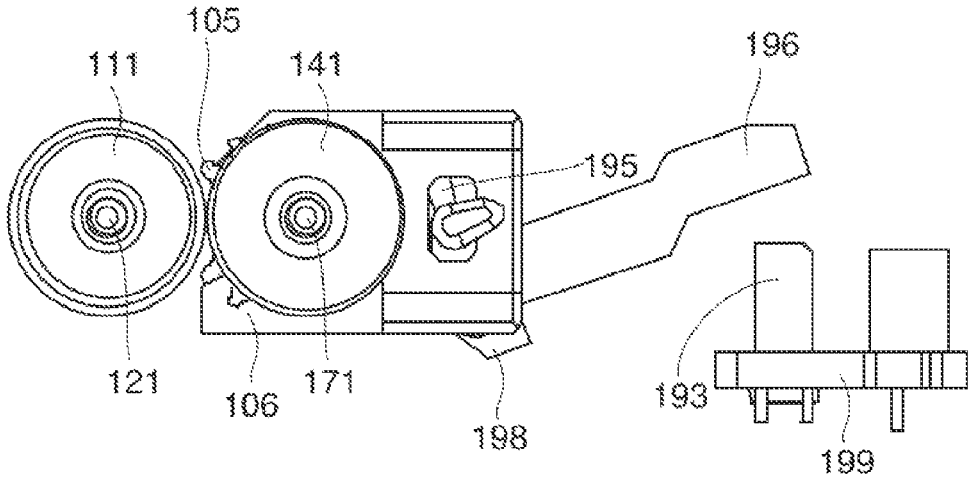
Figure 11C:
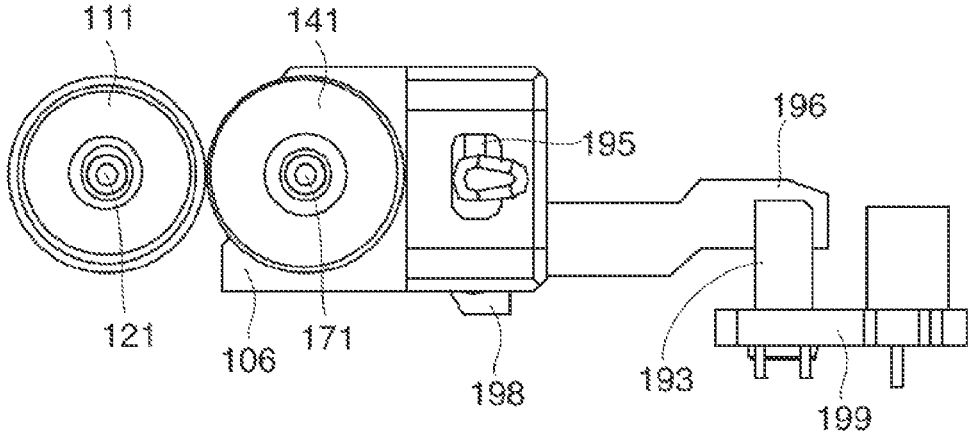
Figure 12A:
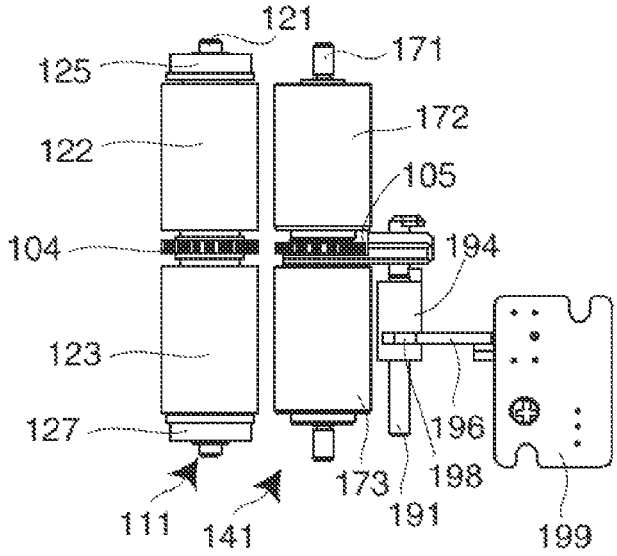
Figure 12B:
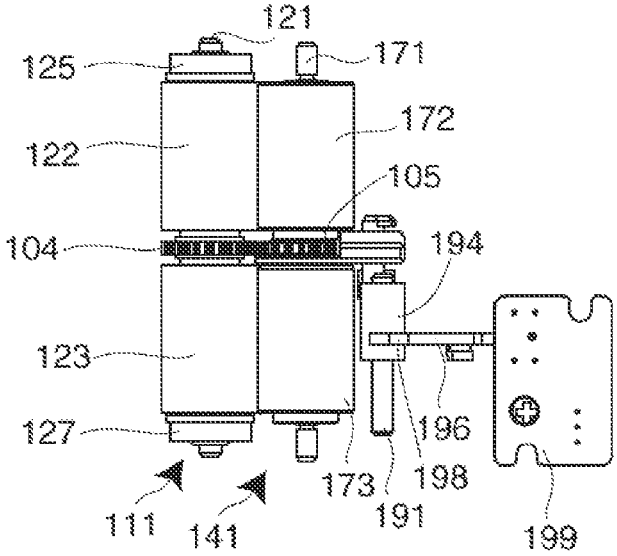
Figure 12C:
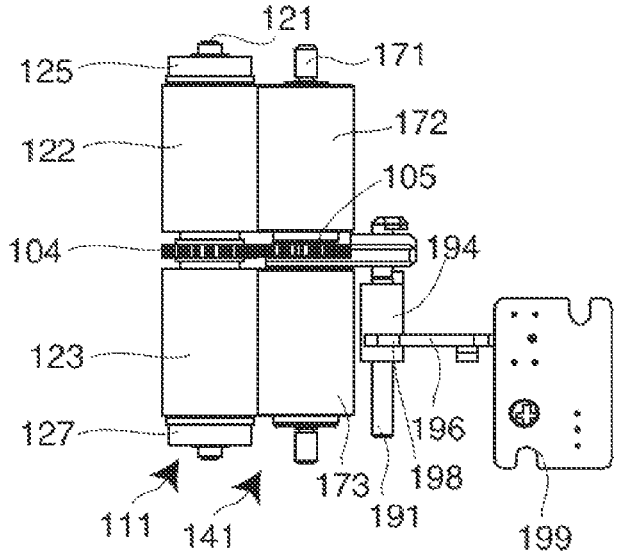
Figure 13A:
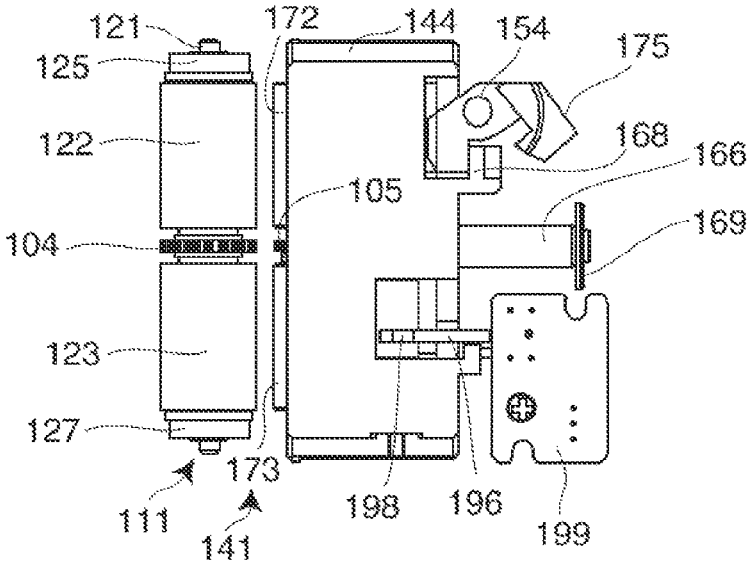
Figure 13B:
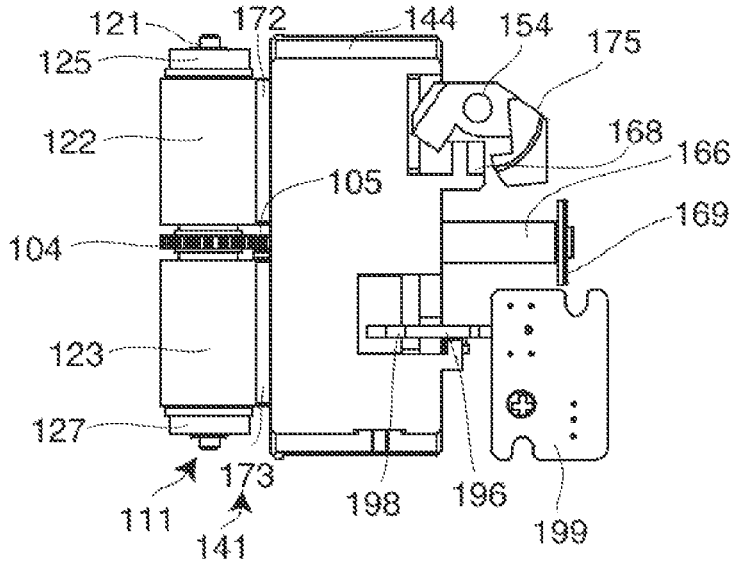
Figure 13C:
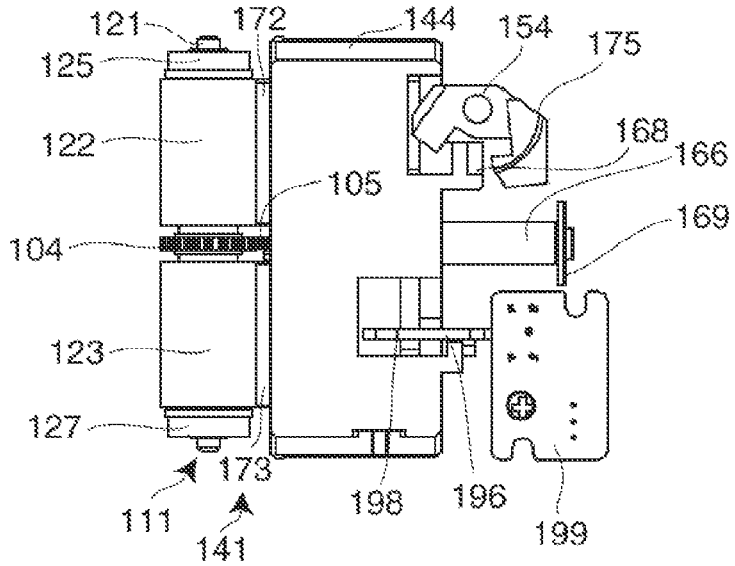
Figure 14A:
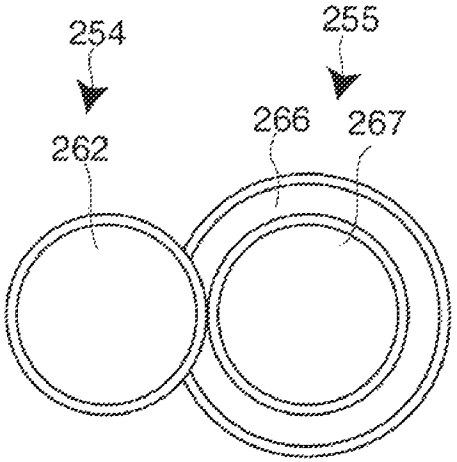
Figure 14B:
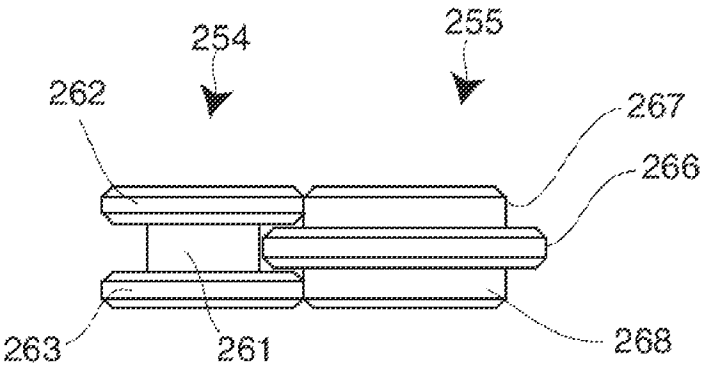
Figure 14C:
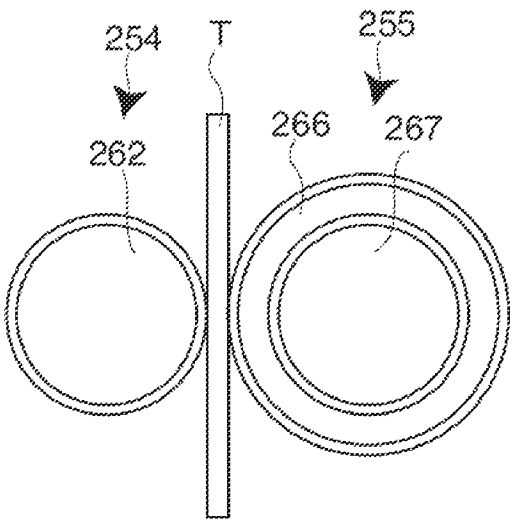
Figure 14D:
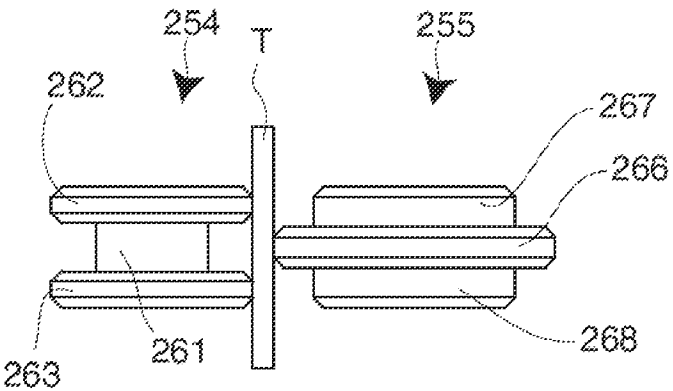

The driving side rotation body 104 attached to the driving roller shaft 121 is disposed between the driving side upper roller main body 122 and the driving side lower roller main body 123. A driving side rotation body teeth portion 131 (first concavo-convex portion) is provided on the outer circumferential surface of the driving side rotation body 104 as a gear-shaped portion forming a concavo-convex shape in the circumferential direction. Moreover, the driving side rotation body hole 132 is provided at the center of the driving side rotation body 104 to engage with the upper roller engaging convex 124 and the lower roller engaging convex 126 and allow the driving roller shaft 121 to be inserted through. The driving side rotation body 104 has a diameter substantially equivalent to each diameter of the driving side upper roller main body 122 and the driving side lower roller main body 123 of the discharge driving roller 111. Thus, the driving side rotation body 104 does not project in the radial direction from the driving side upper roller main body 122 and the driving side lower roller main body 123 when the driving side rotation body 104 is attached to the driving roller shaft 121 (see FIGS. 11A through 11C).

When the upper roller engaging convex 124 and the lower roller engaging convex 126 engage with the driving side rotation body hole 132, the driving side upper roller main body 122, the driving side lower roller main body 123, and the driving side rotation body 104 become one body supported by the driving roller shaft 121. When the rotational power of the tape feed motor 41 is transmitted to the lower roller gear 127 via the discharge power transmission mechanism 103, the driving side upper roller main body 122, the driving side lower roller main body 123, and the driving side rotation body 104 are rotated as one body. During delivery of the printing tape T, the driving side rotation body 104 and the driven side rotation body 105 are located substantially in the middle part of the printing tape T in the width direction of the printing tape T regardless of the tape width.

Figure 8:
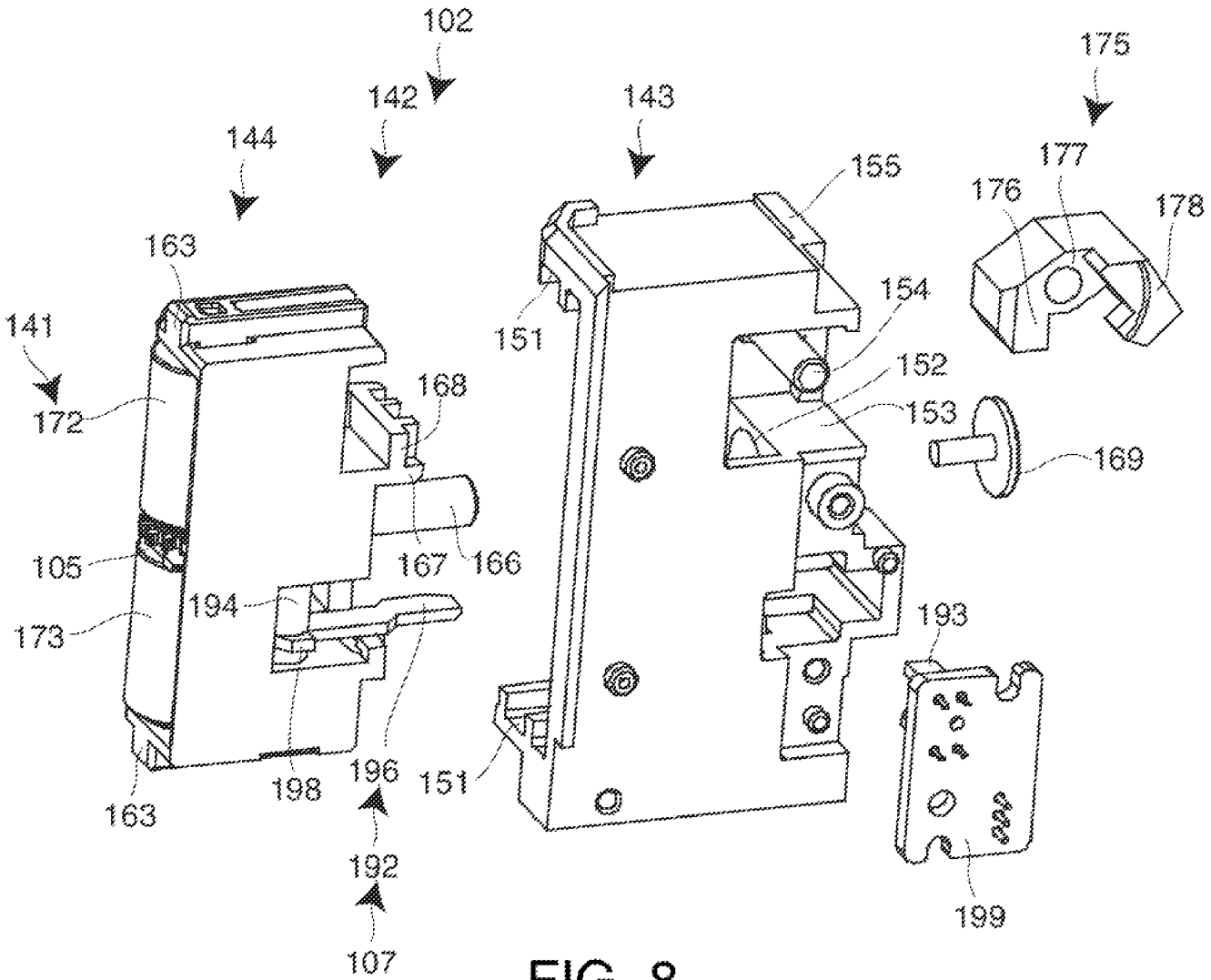
FIG. 8 is a perspective view of a part of the tape discharging mechanism around a driven roller unit in a disassembled condition.

As illustrated in FIG. 8, the driven roller unit 102 includes the discharge driven roller 141, and a driven roller holder 142 which holds the discharge driven roller 141 and the driven side rotation body 105 such that the roller 141 and the body 105 can freely rotate.

The driven roller holder 142 has a fixed holder 143 fixed to the base frame, and a movable holder 144 which supports the discharge driven roller 141 such that the roller 141 can freely rotate. The movable holder 144 is housed in the fixed holder 143 in such a condition as to freely slide to allow the discharge driven roller 141 to move close to and away from the discharge driving roller 111.

The fixed holder 143 has a box shape which opens to the driving roller unit 101 side and the upstream side in the tape feed direction, and includes a pair of upper and lower guide grooves 151 formed in the lower surface of the upper wall of the fixed holder 143 and the upper surface of the lower wall of the fixed holder 143 to guide the slide of the movable holder 144, a guide block 153 provided substantially in the middle of the fixed holder 143 in the up-down direction and at the end thereof on the side opposite to the driving roller unit 101 and having a circular guide hole 152 for guiding a slide rod 166 of the movable holder 144, a hook support shaft 154 provided above the guide block 153 and projected toward the downstream side in the tape feed direction to support the hook member 175 (described below) such that the hook member 175 can freely rotate, and a driven side attachment piece 155 projected from the open edge of the fixed holder 143 on the upstream side in the tape feed direction and attached to the base frame (not shown). In addition, an interlock engagement receiving portion (not shown) engaging with an interlock engaging portion 198 (described below) is provided on the lower inner surface of the side wall of the fixed holder 143.

Figure 9:
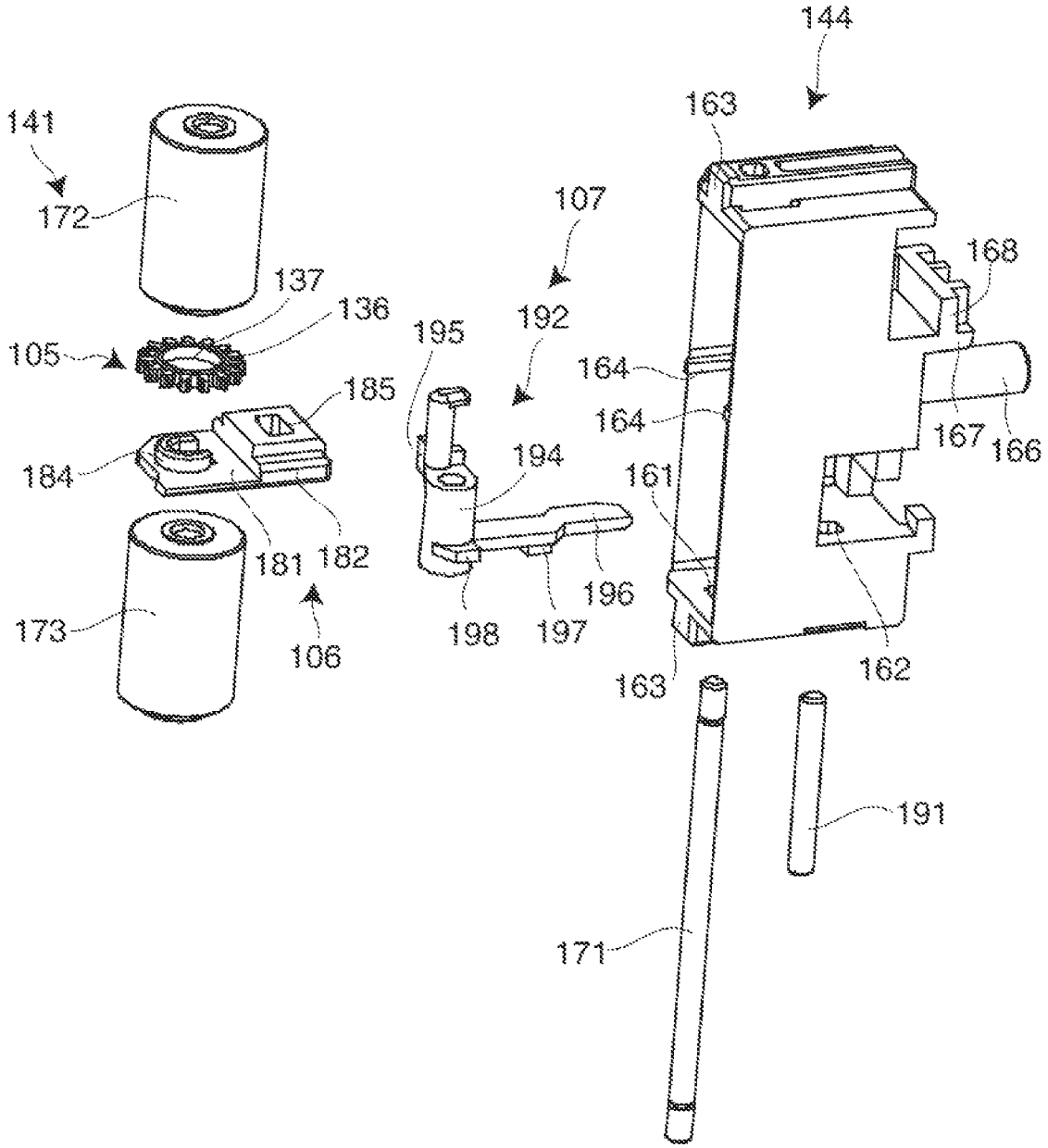
FIG. 9 is a perspective view of the driven roller unit around a movable holder in a disassembled condition.

As illustrated in FIG. 9, the movable holder 144 has a box shape which opens to the driving roller unit 101 side. A pair of upper and lower driven roller bearings 161 are provided on the lower surface of the upper wall of the movable holder 144 and the upper surface of the lower wall of the movable holder 144 to support a driven roller shaft 171 (described below) at the end of the movable holder 144 on the driving roller unit 101 side. Moreover, a rotation member bearing 162 is provided on the upper surface of the lower wall of the movable holder 144 on the side opposite to the driving roller unit 101 side with respect to the lower driven roller bearings 161 to support the lower end of a rotation member support shaft 191 (described below).

The movable holder 144 includes a pair of upper and lower guide ribs 163 provided on the upper surface of the upper wall of the movable holder 144 and the lower surface of the lower wall of the movable holder 144 to engage with the corresponding guide grooves 151, a pair of slide guides 164 formed substantially in the middle areas of the inner surfaces of the movable holder 144 on the upstream side and the downstream side in the tape feed direction and extended in the front-rear direction to guide the slide of the rotation body slider 106, a spring receiving portion (not shown) disposed opposed to the guide block 153 of the fixed holder 143 to contact one end of a not-shown return spring (described below), the slide rod 166 projecting from the spring receiving member toward the side (front side) opposite to the driving roller unit 101 and penetrating the guide hole 152 of the fixed holder 143, a horizontal portion 167 formed above the slide rod 166 to connect the side surfaces of the movable holder 144 on the upstream side and the downstream side in the tape feed direction, and a holder engagement receiving portion 168 projecting from the end of the upper surface of the horizontal portion 167 on the side opposite to the driving roller unit 101 to engage with the hook member 175. A separation preventing pin 169 which prevents separation of the slide rod 166 from the guide hole 152 is screwed into the end of the slide rod 166.

The discharge driven roller 141 has a driven roller shaft 171 whose upper and lower ends are supported by the pair of the driven roller bearings 161, and a driven side upper roller main body 172 and a driven side lower roller main body 173 rotatably supported by the driven roller shaft 171. The discharge driven roller 141 rotates in accordance with the rotation of the discharge driving roller 111.

The driven side rotation body 105 is rotatably supported around the driven roller shaft 171, and disposed between the driven side upper roller main body 172 and the driven side lower roller main body 173 together with the rotation body slider 106 supporting the driven side rotation body 105. A driven side rotation body teeth portion 136 (second concavo-convex portion) is provided on the outer circumferential surface of the driven side rotation body 105 as a gear-shaped portion forming a concavo-convex shape in the circumferential direction. The driven side rotation body 105 further has a circular driven side rotation body hole 137 into which the driven roller shaft 171 is inserted with a clearance between the hole 137 and the shaft 171. The driven side rotation body 105 has a diameter substantially equivalent to each diameter of the driven side upper roller main body 172 and the driven side lower roller main body 173 of the discharge driven roller 141. Thus, the driven side rotation body 105 does not protrude in the radial direction from the driven side upper roller main body 172 and the driven side lower roller main body 173 when the rotation body slider 106 is moved to a retreating position (see FIGS. 11A through 11C). The details of this retreating condition will be described below.

The driven side rotation body teeth portion 136 has a shape complementary to the shape of the driving side rotation body teeth portion 131 such that the driving side rotation body 104 and the driven side rotation body 105 can engage with each other. When the printing tape T is not present between the driven side rotation body 105 and the driving side rotation body 104, the driven side rotation body 105 engages and overlaps with the driving side rotation body 104, and rotates in accordance with the rotation of the driving side rotation body 104. When the printing tape T positions between the driving side rotation body 104 and the driven side rotation body 105, the driven side rotation body 105 disengages from the driving side rotation body 104. The overlapping width between the driving side rotation body 104 and the driven side rotation body 105 is in the range of several millimeters, for example.

The connection and disconnection mechanism 108 moves the discharge driven roller 141 toward the discharge driving roller 111 to reach a nip position where the printing tape T can be nipped between the discharge driving roller 111 and the discharge driven roller 141 in accordance with closing of the opening and closing cover 6, and moves the discharge driven roller 141 to a separation position where the discharge driven roller 141 is separated from the discharge driving roller 111 in accordance with opening of the opening and closing cover 6. The connection and disconnection mechanism 108 has the hook member 175 rotatable around the hook support shaft 154 of the fixed holder 143, and the return spring engaging with the outer surface of the slide rod 166 of the movable holder 144. One end of the return spring contacts the spring receiving portion of the movable holder 144, while the other end contacts the guide block 153 of the fixed holder 143, in which the movable holder 144 is urged in the direction from the fixed holder 143 toward the driving roller unit 101.

The hook member 175 includes a hook engaging portion 176 engaging with the holder engagement receiving portion 168 of the fixed holder 143, an axial hole forming portion 177 which continues from the hook engaging portion 176 while bended and has an axial hole substantially at the center of the axial hole forming portion 177 to allow the hook support shaft 154 to be inserted through, and a projection receiving portion 178 which continues from the axial hole forming portion 177 while bended to engage with the operational projection 6*a* of the opening and closing cover 6. The hook support shaft 154 includes a not-shown engaging spring (torsion spring) which rotationally urges the hook member 175 in such a direction that the hook engaging portion 176 engages with the holder engagement receiving portion 168.

The hook member 175 is urged by the engaging spring to rotate in such a direction that the hook engaging portion 176 engages with the holder engagement receiving portion 168 when the operational projection 6*a* disengages from the projection receiving portion 178 in accordance with opening of the opening and closing cover 6. As a result, the discharge driven roller 141 moves toward the separation position while resisting the return spring. On the other hand, when the operational projection 6*a* engages with the projection receiving portion 178 in accordance with closing of the opening and closing cover 6, the hook engaging portion 176 rotates in such a direction that the hook engaging portion 176 disengages from the holder engagement receiving portion 168 while resisting the engaging spring. As a consequence, the discharge driven roller 141 returns to the nip position by the force of the return spring.

When the discharge driven roller 141 moves to the separation position in accordance with opening of the opening and closing cover 6 in this manner, the clearance between the discharge driving roller 111 and the discharge driven roller 141 increases. Accordingly, even when the printing tape T protrudes from the tape outlet port 38 at the time of setting of the tape cartridge C to the cartridge attachment portion 10, the tape cartridge C can be set in such a condition that the printing tape T securely positions between the discharge driving roller 111 and the discharge driven roller 141. After the tape cartridge C is set to the cartridge attachment portion 10, the discharge driven roller 141 moves to the nip position in accordance with closure of the opening and closing cover 6. As a result, the printing tape T comes to a condition for rotation and delivery by the discharge driving roller 111 and the discharge driven roller 141.

A rotation member 192 (described below) is supported by the movable holder 144 similarly to the discharge driven roller 141, and therefore is allowed to achieve reciprocative movement by the function of the connection and disconnection mechanism 108 in accordance with opening and closing of the opening and closing cover 6.

The rotation body slider 106 has a substantially rectangular shape in the plan view, and includes a rotation body support portion 181 provided on the half part of the rotation body slider 106 on the driving roller unit 101 side to support the driven side rotation body 105 in such a manner that the driven side rotation body 105 can freely rotate, and a rotation member engaging portion 182 provided on the half part of the rotation body slider 106 on the side opposite to the driving roller unit 101 side and having a larger thickness than that of the rotation body support portion 181.

Figure 10A:
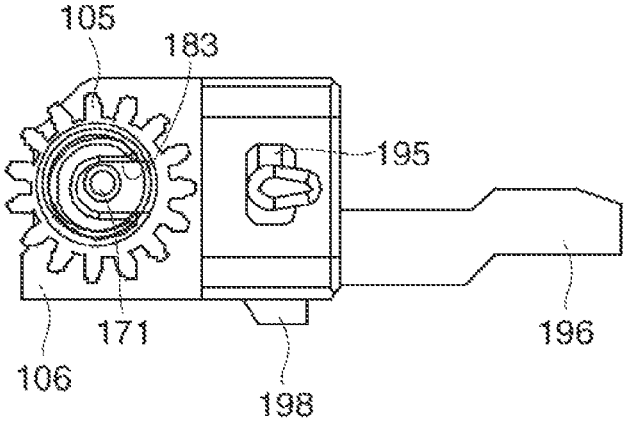
Figure 10B:
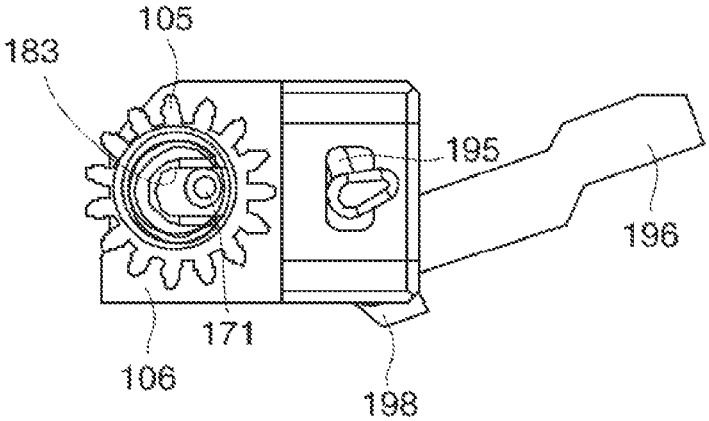
Figure 10C:
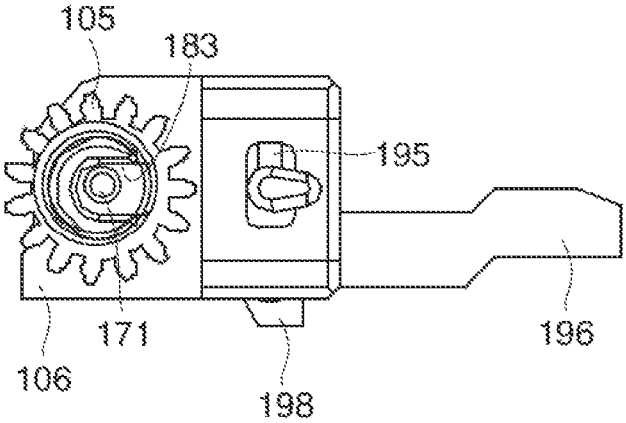

The rotation body support portion 181 has a long hole 183 (see FIGS. 10A through 10C) extending in the sliding direction of the rotation body slider 106. The driven roller shaft 171 is inserted through the long hole 183 such that the rotation body slider 106 can slide with respect to the discharge driven roller 141. A support convex 184 projects from the upper surface of the rotation body support portion 181 while extending along the circular-arc-shaped outer edge of the long hole 183 on the driving roller unit 101 side. The driven side rotation body 105 is supported rotatably around the driven roller shaft 171 by engagement between the support convex 184 and the driven side rotation body hole 137 of the driven side rotation body 105. On the other hand, an engaging hole 185 engaging with an engaging arm 195 (described below) of the rotation member 192 is formed in the rotation member engaging portion 182.

The rotation body slider 106 slides between an advancing position where the driven side rotation body 105 supported by the rotation body slider 106 engages with the driving side rotation body 104 and the retreating position where the driven side rotation body 105 disengages from the driving side rotation body 104, while guided by the slide guides 164.

The detection mechanism 107 includes a rotation member support shaft 191 whose lower end is supported by the rotation member bearing 162 formed on the movable holder 144, the rotation member 192 rotatably supported by the rotation member support shaft 191, and the slider detector 193 attached to the vicinity of an area below the guide block 153 of the fixed holder 143 via an attachment board 199 having a substantially square shape. The detection mechanism 107 further includes a rotation urging spring (not shown) which urges the rotation of the engaging arm 195 (described below) engaging with the rotation body slider 106 in such a direction that the rotation body slider 106 slides toward the advancing position.

The rotation member 192 has a cylindrical shaft 194 into which the rotation member support shaft 191 is inserted, the engaging arm 195 which extends in the radial direction from the upper end of the shaft 194 and having an engaging portion engaging with the engaging hole 185, and a detection arm 196 which extends in the radial direction from the lower end of the shaft 194 while crossing the engaging arm 195 substantially at right angles. The end (detection target portion) of the detection arm 196 faces to the slider detector 193. The detection arm 196 is longer than the engaging arm 195.

The rotation member 192 rotates in accordance with the sliding movement of the rotation body slider 106 between the advancing position and the retreating position by engagement between the engaging arm 195 and the engaging hole 185 of the rotation body slider 106. The engaging arm 195 and the detection arm 196 of the rotation member 192 reciprocatively rotate around the shaft 194 (rotation member support shaft 191) in accordance with the sliding movement of the rotation body slider 106 between the advancing position and the retreating position. In this case, the shaft 194 converts rotation of the engaging arm 195 in the front-rear direction into rotation of the detection arm 196 in the left-right direction, in which the amplitude of the rotation of the detection arm 196 becomes several times larger than the amplitude of the rotation of the engaging arm 195 by the larger length of the detection arm 196 than the length of the engaging arm 195. In the following description, the rotation directions of the engaging arm 195 and the detection arm 196 when the rotation body slider 106 slides from the advancing position to the retreating position is referred to as a retreating rotation direction, while the rotation directions of the engaging arm 195 and the detection arm 196 when the rotation body slider 106 slides from the retreating position to the advancing position is referred to as an advancing rotation direction.

A fitting portion 197 to which one end of the rotation urging spring is fitted is provided on the lower surface of a bended portion of the detection arm 196 located approximately in the middle area thereof and bended in a crank shape in the plan view. The rotation urging spring is constituted by a torsion spring wound around the rotation member support shaft 191. One end of the rotation urging spring is fitted to the fitting portion 197, while the other end is fitted to the inside of the fixed holder 143. The rotation urging spring urges the engaging arm 195 in the advancing rotation direction. In other words, the rotation urging spring urges the rotation body slider 106 toward the advancing position via the engaging arm 195.

Moreover, an interlock engaging portion 198 projecting to the side opposite to the extending direction of the engaging arm 195 is provided on the shaft 194 of the rotation member 192 in the vicinity of the base end of the detection arm 196. The rotation member 192 supported by the movable holder 144 similarly to the discharge driven roller 141 moves toward an engagement position for engaging with the interlock engagement receiving portion formed inside the fixed holder 143 in accordance with the movement of the discharge driven roller 141 from the nip position to the separation position, and moves toward a disengagement position for disengaging from the interlock engagement receiving portion in accordance with the movement of the discharge driven roller 141 from the separation position to the nip position.

When the interlock engaging portion 198 engages with the interlock engagement receiving portion, the engaging arm 195 rotates in the retreating rotation direction while resisting the rotation urging spring. As a result, the rotation body slider 106 moves toward the retreating position with respect to the discharge driven roller 141. When the interlock engaging portion 198 disengages from the interlock engagement receiving portion, the engaging arm 195 rotates in the advancing rotation direction while urged by the rotation urging spring. As a result, the rotation body slider 106 moves toward the advancing position with respect to the discharge driven roller 141.

The slider detector 193 is constituted by a transmission-type optical sensor (photo-interrupter), and disposed opposed to the tip of the detection arm 196 rotated to the rotation end in the retreating rotation direction. When the tip of the detection arm 196 is inserted between light emitting elements of the slider detector 193 disposed opposed to each other, the slider detector 193 determines that the rotation body slider 106 has slid to the retreating position based on interruption of light thus caused.

The slider detector 193 may be constituted by a contact-type sensor. However, when the slider detector 193 is constituted by a non-contact-type sensor as in this embodiment, the rotation body slider 106 is not required to have a force for pressing a contact of the sensor when arriving at the retreating position unlike the case of the contact-type sensor which requires this force. Accordingly, the rotation body slider 106 is movable by the smallest possible force, wherefore detection can be achieved even when the printing tape T is thin.

A series of actions of the printing tape T around the tape discharging mechanism 12 at the time of opening and closing of the opening and closing cover 6 and during feeding (discharging) of the printing tape T are now discussed with reference to FIGS. 10A through 13C.

As illustrated in FIGS. 10A, 11A, 12A, and 13A, the operational projection 6*a* of the opening and closing cover 6 disengages from the projection receiving portion 178 of the hook member 175 when the opening and closing cover 6 is opened. By this disengagement, the hook engaging portion 176 of the hook member 175 engages with the holder engagement receiving portion 168. As a result, the discharge driving roller 111 moves from the nip position to the separation position, while the rotation member 192 moves from the disengagement position to the engagement position. In accordance with the movement of the discharge driving roller 111 to the separation position, the driven side rotation body 105 supported around the driven roller shaft 171 also separates from the driving side rotation body 104, whereby the clearance between the driving side rotation body 104 and the driven side rotation body 105 increases.

Then, the interlock engaging portion 198 engages with the interlock engagement receiving portion in accordance with the movement of the rotation member 192 to the engagement position, whereby the engagement arm 195 and the detection arm 196 rotate in the retreating rotation direction. As a result, the rotation body slider 106 moves to the retreating position away from the discharge driving roller 111, in which the driven side rotation body 105 does not project toward the driving side rotation body 104 of the discharge driving roller 111.

According to this structure, the discharge driven roller 141 moves to the separation position in accordance with opening of the opening and closing cover 6, whereby the rotation body slider 106 moves to the retreating position with respect to the discharge driving roller 111. In this case, the clearance between the discharge driving roller 111 and the discharge driven roller 141 increases, wherefore the clearance between the driving side rotation body 104 and the driven side rotation body 105 also increases. Accordingly, this structure allows setting of the tape cartridge C to the cartridge attachment portion 10 while securely positioning the printing tape T between the discharge driving roller 111 and the discharge driven roller 141 and between the driving side rotation body 104 and the driven side rotation body 105 even when the printing tape T projects from the tape outlet port 38 at the time of setting of the tape cartridge C to the cartridge attachment portion 10.

When the opening and closing cover 6 is closed after setting of the tape cartridge C, the operational projection 6*a* of the opening and closing cover 6 engages with the projection receiving portion 178 of the hook member 175. By this engagement, the hook engaging portion 176 of the hook member 175 disengages from the holder engagement receiving portion 168 as illustrated in FIGS. 10B, 11B, 12B, and 13B. As a result, the discharge driving roller 111 moves from the separation position to the nip position, while the rotation member 192 moves from the engagement position to the disengagement position. In accordance with the movement of the rotation member 192 to the disengagement position, the interlock engaging portion 198 disengages from the interlock engagement receiving portion.

When the printing tape T does not position between the driving side rotation body 104 and the driven side rotation body 105, the engaging arm 195 and the detection arm 196 rotate in the advancing rotation direction. As a result, the rotation body slider 106 moves to the advancing position with respect to the discharge driving roller 111, whereby the driven side rotation body 105 supported by the rotation body slider 106 engages with the driving side rotation body 104 while overlapping therewith. In this condition, the detection arm 196 does not face to the slider detector 193. Thus, the slider detector 193 recognizes that the rotation body slider 106 does not move to the retreating position, and determines that the printing tape T is not present between the driving side rotation body 104 and the driven side rotation body 105 or between the discharge driving roller 111 and the discharge driven roller 141.

When the printing tape T positions between the discharge driving roller 111 and the discharge driven roller 141 after printing as illustrated in FIGS. 10C, 11C, 12C, and 13C, the driven side rotation body 105 supported rotatably around the driven roller shaft 171 rotates and receives the printing tape T without interrupting passage of the feed target medium by the presence of the driving side rotation body 104 and the driven side rotation body 105.

When the printing tape T enters between the driving side rotation body 104 and the driven side rotation body 105, the driven side rotation body 105 disengages from the driving side rotation body 104 to cancel the condition of overlap with the driving side rotation body 104. As a result, the rotation body slider 106 supporting the driven side rotation body 105 moves from the advancing position to the retreating position by the sum of the thickness of the printing tape T and the length sufficient for canceling the overlap.

In accordance with the movement of the rotation body slider 106 to the retreating position, the engaging arm 195 and the detection arm 196 of the rotation member 192 rotate toward the retreating rotation direction, whereby the tip of the detection arm 196 faces to the slider detector 193. In this condition, the slider detector 193 recognizes that the rotation body slider 106 has moved to the retreating position, and determines that the printing tape T is present between the driving side rotation body 104 and the driven side rotation body 105 and between the discharge driving roller 111 and the discharge driven roller 141.

The detection arm 196 of the rotation member 192 is longer than the engaging arm 195, wherefore the tip of the detection arm 196 facing to the slider detector 193 is disposed at a position outside the engaging portion of the engaging arm 195 in the radial direction of the shaft 194. According to this structure, the rotation distance of the detection arm 196 is longer than the rotation distance of the engaging arm 195 dependent on the moving distance of the rotation body slider 106 between the advancing position and the retreating position. Thus, the migration of the rotation body slider 106 to the retreating position can be detected with higher accuracy. In this case, the overlap between the driving side rotation body 104 and the driven side rotation body 105 may be reduced by the length of the difference between the rotation distance of the engaging arm 195 in correspondence with the moving distance of the rotation body slider 106 and the rotation distance of the detection arm 196 longer than the rotation distance of the engaging arm 195.

Accordingly, the tape printer 1 in this embodiment can set the tape cartridge C while securely positioning the printing tape T between the discharge driving roller 111 and the discharge driven roller 141 and between the driving side rotation body 104 and the driven side rotation body 105 even when the printing tape T projects from the tape outlet port 38 at the time of setting of the tape cartridge C to the cartridge attachment portion 10. Moreover, this structure can securely detect the presence or absence of the printing tape T between the discharge driving roller 111 and the discharge driven roller 141.

According to this embodiment, as described above, the driving side rotation body 104 and the driven side rotation body 105 have the driving side rotation body teeth portion 131 and the driven side rotation body teeth portion 136, respectively. However, these parts may be constructed otherwise as long as the driving side rotation body 104 and the driven side rotation body 105 can engage and overlap with each other, and disengage from each other in response to the presence of the printing tape T positioned therebetween.

A driving side rotation body 254 and a driven side rotation body 255 according to another embodiment are hereinafter described with reference to FIGS. 14A through 14D. The driving side rotation body 254 has a roller shape which includes a driving side small-diameter portion 261, and a driving side first large-diameter portion 262 and a driving side second large-diameter portion 263 provided on both end surfaces of the driving side small-diameter portion 261, respectively, and disposed coaxially with the driving side small-diameter portion 261. These components 261 through 263 are formed integrally with each other and constitute a driving side concavo-convex portion (not shown) as a whole which has an outer circumferential surface concavo-convex in the axial direction. The driving side first large-diameter portion 262 and the driving side second large-diameter portion 263 have substantially the same diameter as each diameter of the driving side upper roller main body 122 and the driving side lower roller main body 123 of the discharge driving roller 111. Thus, the driving side first large-diameter portion 262 and the driving side second large-diameter portion 263 do not project from the driving side upper roller main body 122 and the driving side lower roller main body 123 in the radial direction when attached to the driving roller shaft 121.

The driven side rotation body 255 has a roller shape which includes a driven side large-diameter portion 266, and a driven side first small-diameter portion 267 and a driven side second small-diameter portion 268 provided on both end surfaces of the driven side large-diameter portion 266, respectively, and disposed coaxially with the driven side large-diameter portion 266. These components 266 through 268 are formed integrally with each other and constitute a driven side concavo-convex portion (not shown) as a whole which has an outer circumferential surface concavo-convex in the axial direction and a shape complementary to the driving side concavo-convex portion. The driven side large-diameter portion 266 has substantially the same diameter as each diameter of the driven side upper roller main body 172 and the driven side lower roller main body 173 of the discharge driven roller 141. Thus, the driven side large-diameter portion 266 does not project from the driven side upper roller main body 172 and the driven side lower roller main body 173 in the radial direction when the rotation body slider 106 reaches the retreating position.

Similarly to the above embodiment, the driving side rotation body 254 has a not-shown driving side rotation body hole, while the driven side rotation body 255 has a not-shown driven side rotation body hole.

Similarly to the above embodiment, the driving side rotation body 254 and the driven side rotation body 255 in this embodiment engage and overlap with each other, and disengage from each other in response to the presence of the printing tape T. Similarly to the driving side rotation body 104 and the driven side rotation body 105 in the above embodiment, the driving side rotation body teeth portion 131 and the driven side rotation body teeth portion 136 having concavo-convex shapes in the circumferential direction can prevent easy bending of the printing tape T along the driving side rotation body teeth portion 131 and the driven side rotation body teeth portion 136 when the printing tape T which is thin or made of soft material positions between the driving side rotation body teeth portion 131 and the driven side rotation body teeth portion 136. Accordingly, this structure can sufficiently cancel the overlapping condition, and thus can securely move the rotation body slider 106 by the amount of overlap.

What is claimed is:

1. A medium feeder, comprising:

a feed roller which has a first roller and a second roller, and rotates to deliver a feed target medium while nipping the feed target medium;

a first rotation body attached to a first roller shaft of the first roller;

a second rotation body which engages with the first rotation body while overlapping with the first rotation body, and disengages from the first rotation body in response to the presence of the feed target medium nipped between the first and second rotation bodies;

a rotation body support member which supports the second rotation body rotatably around a second roller shaft of the second roller, and is configured to be movable relative to the second roller, and movable between an advancing position where the second rotation body engages with the first rotation body and a retreating position where the second rotation body disengages from the first rotation body;

a detection unit which detects migration of the rotation body support member to the retreating position; and a rotation member that includes a shaft, an engaging portion which engages with the rotation body support member and reciprocatively rotates around the shaft in accordance with the movement of the rotation body support member between the advancing position and the retreating position, and a detection target portion which reciprocatively rotates around the shaft in accordance with the movement of the rotation body support member between the advancing position and the retreating position, wherein the detection target portion is disposed outside the engaging portion in the radial direction of the shaft, and the detection unit faces to one of the rotation ends of the detection target portion.

2. The medium feeder according to claim 1, wherein the first rotation body has a first concavo-convex portion which has an outer circumferential surface concavo-convex in the circumferential direction; and the second rotation body has a second concavo-convex portion which has an outer circumferential surface concavo-convex in the circumferential direction and complementary to the first concavo-convex portion, and thus can engage with the first rotation body while overlapping with the first rotation body.

3. The medium feeder according to claim 1, wherein:

the first rotation body has a first concavo-convex portion which has an outer circumferential surface concavo-convex in the axial direction; and the second rotation body has a second concavo-convex portion which has an outer circumferential surface concavo-convex in the axial direction and complementary to the first concavo-convex portion to engage with the first rotation body while overlapping with the first rotation body.

4. The medium feeder according to claim 1, wherein the detection unit includes a non-contact-type sensor.

5. The medium feeder according to claim 1, further comprising:

a medium setting portion to which the feed target medium as a target of delivery by rotation of the feed roller is set;

an opening and closing member which opens and closes the medium setting portion; and a connection and disconnection mechanism which moves the second roller close to and away from the first roller between a nip position where the feed target medium is nipped between the first and second rollers and a separation position where the second roller is separated away from the first roller in accordance with closing of the opening and closing member.

6. A printer, comprising:

the medium feeder according to claim 1; and a printing unit which performs printing on the feed target medium delivered by rotation of the medium feeder.

7. A medium feeder comprising:

a first rotation body;

a second rotation body which engages with the first rotation body while overlapping with the first rotation body, and disengages from the first rotation body in response to the presence of a feed target medium nipped between the first and second rotation bodies;

a rotation body support member which supports the second rotation body, and is configured to be movable between an advancing position where the second rotation body engages with the first rotation body and a retreating position where the second rotation body disengages from the first rotation body;

a detection unit which detects migration of the rotation body support member to the retreating position; and a rotation member that includes a shaft, an engaging portion which engages with the rotation body support member and reciprocatively rotates around the shaft in accordance with the movement of the rotation body support member between the advancing position and the retreating position, and a detection target portion which reciprocatively rotates around the shaft in accordance with the movement of the rotation body support member between the advancing position and the retreating position, wherein the detection target portion is disposed outside the engaging portion in the radial direction of the shaft, and the detection unit faces to one of the rotation ends of the detection target portion.

8. A medium feeder, comprising:

a feed roller which has a first roller and a second roller, and rotates to deliver a feed target medium while nipping the feed target medium by the first and second rollers;

a connection and disconnection mechanism which moves the second roller close to and away from the first roller between a nip position where the feed target medium is nipped between the first and second rollers and a separation position where the second roller is separated away from the first roller;

a first rotation body attached to a first roller shaft of the first roller;

a second rotation body which engages with the first rotation body while overlapping with the first rotation body, and disengages from the first rotation body in response to the presence of the feed target medium nipped between the first and second rotation bodies;

a rotation body support member which supports the second rotation body such that the second rotation body can freely rotate around a second roller shaft of the second roller, and moves relative to the second roller in such a manner as to freely move between an advancing position where the second rotation body engages with the first rotation body and a retreating position where the second rotation body disengages from the first rotation body; and an interlock mechanism which moves the rotation body support member from the advancing position to the retreating position with respect to the second roller in accordance with the movement of the second roller from the nip position to the separation position, and moves the rotation body support member from the retreating position to the advancing position with respect to the second roller in accordance with the movement of the second roller from the separation position to the nip position, wherein the interlock mechanism includes an urging member which urges the rotation body support member toward the advancing position, and an interlock engaging portion and an interlock engagement receiving portion which engage with each other in accordance with the movement of the second roller from the nip position to the separation position, and disengage from each other in accordance with the movement of the second roller from the separation position to the nip position, and wherein the interlock mechanism moves the rotation body support member from the advancing position to the retreating position by engagement between the interlock engaging portion and the interlock engagement receiving portion while resisting the urging member, and allows movement of the rotation body support member toward the advancing position by the operation of the urging member in accordance with disengagement between the interlock engaging portion and the interlock engagement receiving portion.

9. The medium feeder according to claim 8, wherein:

the interlock mechanism further includes a rotation member that includes a shaft on the outer circumferential surface of which the interlock engaging portion is provided, and a support member engaging portion which engages with the rotation body support member and reciprocatively rotates around the shaft in accordance with the engagement and disengagement between the interlock engaging portion and the interlock engagement receiving portion so as to move the rotation body support member between the advancing position and the retreating position; and the rotation member allows the interlock engaging portion to move to an engagement position where the interlock engaging portion engages with the interlock engagement receiving portion in accordance with the movement of the second roller from the nip position to the separation position, and allows the interlock engaging portion to move to a disengagement position where the interlock engaging portion disengages from the interlock engagement receiving portion in accordance with the movement of the second roller from the separation position to the nip position.

10. The medium feeder according to claim 9, wherein:

the rotation member further includes a detection target portion which reciprocatively rotates around the shaft in accordance with the movement of the rotation body support member between the advancing position and the retreating position; and the medium feeder further includes a detection unit which faces to one of the rotation ends of the detection target portion.

11. The medium feeder according to claim 8, further comprising:

a medium setting portion to which the feed target medium as a target of delivery by rotation of the feed roller is set; and an opening and closing member which opens and closes the medium setting portion, wherein the connection and disconnection mechanism moves the second roller from the nip position to the separation position in accordance with opening of the opening and closing member, and moves the second roller from the separation position to the nip position in accordance with closing of the opening and closing member.

12. A printer, comprising:

the medium feeder according to claim 8; and a printing unit which performs printing on the feed target medium delivered by rotation of the medium feeder.

* * * * *